US007564429B2

(12) United States Patent
Yang et al.

(10) Patent No.: US 7,564,429 B2
(45) Date of Patent: Jul. 21, 2009

(54) PLASMA DISPLAY APPARATUS AND DRIVING METHOD THEREOF

(75) Inventors: Heechan Yang, Busan (KR); Yunkwon Jung, Gumi-si (KR); Jinyoung Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 662 days.

(21) Appl. No.: 11/290,439

(22) Filed: Dec. 1, 2005

(65) Prior Publication Data

US 2006/0125725 A1 Jun. 15, 2006

(30) Foreign Application Priority Data

Dec. 9, 2004 (KR) ..... 10-2004-0103856

(51) Int. Cl.
*G09G 3/28* (2006.01)

(52) U.S. Cl. ..... 345/67; 345/60

(58) Field of Classification Search ..... 345/41–42, 345/60–68, 204, 208, 210–211, 51–54; 315/169.4
See application file for complete search history.

(56) References Cited

U.S. PATENT DOCUMENTS

| | | | | |
|---|---|---|---|---|
| 6,483,485 | B1 * | 11/2002 | Huang et al. | 345/10 |
| 7,358,931 | B2 * | 4/2008 | Mizobata et al. | 345/60 |
| 2001/0017605 | A1 | 8/2001 | Hashimoto et al. | 345/60 |
| 2001/0024179 | A1 * | 9/2001 | Nakamura | 345/60 |
| 2004/0027316 | A1 * | 2/2004 | Kang et al. | 345/60 |
| 2004/0108975 | A1 | 6/2004 | Araki | 345/63 |
| 2005/0088375 | A1 * | 4/2005 | Son | 345/60 |

FOREIGN PATENT DOCUMENTS

| | | |
|---|---|---|
| JP | 08-305319 | 11/1996 |
| JP | 2002-207449 | 7/2002 |

OTHER PUBLICATIONS

Chinese Office Action dated Nov. 30, 2007.
European Search Report dated Jul. 20, 2006.

* cited by examiner

*Primary Examiner*—Richard Hjerpe
*Assistant Examiner*—Mansour M Said
(74) *Attorney, Agent, or Firm*—Ked & Associates LLP

(57) ABSTRACT

A plasma display apparatus and a driving method thereof are provided. The plasma display apparatus comprises: a plasma display panel comprising a plurality of scan electrodes, sustain electrodes, and address electrodes intersecting with the scan electrodes; a scan driver for applying a negative waveform and a reset waveform subsequent to the negative waveform to the scan electrode, and applying a scan waveform subsequent to the reset waveform to the scan electrode; a sustain driver for applying a positive waveform corresponding to the negative waveform to the sustain electrode; and a data driver for applying an address waveform to the address electrode, wherein a scan waveform is applied to one scan electrode and applying time points among at least two address waveforms applied to the address electrode corresponding to the scan waveform are different from each other, wherein, when the temperature of the plasma display panel is more than a threshold temperature, an idle period from an applying time point of a last sustain waveform applied to the scan electrode or the sustain electrode to an applying time point of a predetermined waveform gets different.

20 Claims, 23 Drawing Sheets

PLASMA DISPLAY APPARATUS AND DRIVING METHOD THEREOF

This Nonprovisional application claims priority under 35 U.S.C. § 119(a) on Patent Application No. 10-2004-0103856 filed in Korea on Dec. 9, 2005, the entire contents of which are hereby incorporated by reference.

BACKGROUND OF THE INVENTION

1. Field of the Invention

The present invention relates to a plasma display apparatus and a driving method thereof.

2. Description of the Background Art

In general, a plasma display apparatus comprises a plasma display panel where one unit cell is provided at a space between barrier ribs formed between a front substrate and a rear substrate. Main discharge gas such as neon (Ne), helium (He) or a mixture (He+Ne) of neon and helium and inert gas containing a small amount of xenon (Xe) are filled in each cell. When discharge is performed using high frequency voltage, the inert gas generates vacuum ultraviolet rays and phosphors provided between the barrier ribs are emitted, thereby realizing an image.

The plasma display panel is attracting attention as a next generation display due to its slimness and lightweighting.

FIG. 1 illustrates a structure of a conventional plasma display panel.

As shown in FIG. 1, a plasma display panel comprises a front substrate 100 and a rear substrate 110. The front substrate 100 has a plurality of sustain electrode pairs arranged with a scan electrode 102 and a sustain electrode 103 each paired and formed on a front glass 101, which is a display surface for displaying the image thereon. The rear substrate 110 has a plurality of address electrodes 113 arranged to intersect with the plurality of sustain electrode pairs on a front glass 111, which is spaced apart in parallel with and attached to the front substrate 100.

The front substrate 100 includes the paired scan electrode 102 and the paired sustain electrode 103 for performing a mutual discharge in one pixel and sustaining emission of light, that is, the paired scan electrode 102 and the paired sustain electrode 103 each having a transparent electrode (a) formed of indium-tin-oxide (ITO) and a bus electrode (b) formed of metal. The scan electrode 102 and the sustain electrode 103 are covered with at least one dielectric layer 104, which controls a discharge current and insulates the paired electrodes. A protective layer 105 is formed of magnesium oxide (MgO) on the dielectric layer 104 to facilitate a discharge condition.

The rear substrate 110 includes stripe-type (or well-type) barrier ribs 112 for forming a plurality of discharge spaces (that is, discharge cells) and arranged in parallel. Also, the rear substrate 110 comprises a plurality of address electrodes 113 arranged in parallel with the barrier ribs 112, and performing an address discharge and generating the vacuum ultraviolet rays. Red (R), green (G), blue (B) phosphors 114 emit visible rays for displaying the image in the address discharge, and are coated over an upper surface of the rear substrate 110. Lower dielectric layer 115 for protecting the address electrode 113 is formed between the address electrode 113 and the phosphor 114.

In the above structured plasma display panel, the discharge cells are formed in matrix in plural, and a driving module having a driving circuit for supplying a predetermined pulse to the discharge cell is connected and driven.

FIG. 2 is a view illustrating a conventional method for expressing the image gray level in a plasma display apparatus.

As shown in FIG. 2, in the conventional method for expressing the image gray level in the plasma display apparatus, one frame is divided into several subfields having the different number times of emission. Each subfield is divided into a reset period (RPD) for initializing all cells, an address period (APD) for selecting a discharged cell, and a sustain period (SPD) for expressing the gray level depending on the number times of discharge. For example, when the image is displayed in 256 gray levels, as shown in FIG. 3, a frame period (16.67 ms) corresponding to a 1/60 second is divided into eight subfields (SF1 to SF8), and each of the eight subfields (SF1 to SF8) is divided into the reset period, the address period, and the sustain period. The reset period and the address period are the same at each subfield. The address discharge for selecting the cell to be discharged is generated by a voltage difference between the address electrode and the scan electrode being the transparent electrode. The sustain period is increased in a ratio of $2^n$ (n=0, 1, 2, 3, 4, 5, 6, 7) at each subfield. Since the sustain period is different at each subfield as described above, the sustain period of each subfield (that is, the number times of sustain discharge) is controlled, thereby expressing the image gray level.

In the meantime, in the conventional plasma display apparatus, as a temperature around the plasma display panel gets higher, erroneous discharge is generated. The erroneous discharge generated when the temperature around the panel is high is called "high temperature erroneous discharge". Such the high temperature erroneous discharge will be described with reference to FIG. 3.

FIG. 3 illustrates a charge state within a conventional discharge cell.

Referring to FIG. 3, in the conventional plasma display apparatus, as the temperature around the panel gets higher, a recombination ratio between space charges 301 and wall charges 300 within the discharge cell increases and therefore, an absolute amount of the wall charges participating in the discharge decreases, thereby causing the erroneous discharge. The space charges 301 being charges existing in a space within the discharge cell, refer to charges not participating in the discharge unlike the wall charges 300.

For example, the recombination ratio between the space charges 301 and the wall charges 300 increases in the address period to decrease an amount of the wall charges 300 participating in the address discharge, thereby instabilizing the address discharge. In particular, the later addressing is in sequence, the more a time taken to recombine the space charges 301 with the wall charges 300 is sufficiently secured, thereby more instabilizing the address discharge. Therefore, there occurs the high-temperature erroneous discharge where the discharge cell turned-on in the address period is turned off in the sustain period.

Further, as the temperature around the panel gets higher in the sustain period, when a sustain discharge is performed, a speed of creating the space charges 301 is increased in the discharge and accordingly, the recombination ratio of the space charges 301 and the wall charges 300 are increased. Accordingly, there occurs the high-temperature erroneous discharge where after one-time sustain discharge, the wall charges 300 participating in the sustain discharge are decreased in amount by the recombination of the space charges 301 and the wall charges 300, thereby preventing a next sustain discharge.

FIG. 4 illustrates a driving waveform of a conventional plasma display apparatus.

As shown in FIG. 4, the conventional plasma display apparatus is driven with each subfield divided into the reset period for initializing all cells, the address period for selecting the cell to be discharged, the sustain period for sustaining a discharge of the selected cell, and the erasure period for erasing the wall charge within the discharge cell.

Referring to FIG. 4, in the driving waveform of the conventional plasma display apparatus, all address waveforms applied to the address electrodes ($X_1$ to Xn) are applied at the same time "ts" as the scan waveform applied to the scan electrode in the address period. If the address waveform and the scan waveform are applied to the address electrodes ($X_1$ to Xn) and the scan electrode respectively at the same time point, a noise is generated at the waveform applied to the scan electrode and the waveform applied to the sustain electrode.

This noise results from coupling through capacitance of the panel. At a time point when the address waveform abruptly rises, an up noise is generated at the waveform applied to the scan electrode and the sustain electrode, and at a time point when the address waveform abruptly falls, a down noise is generated at the waveform applied to the scan electrode and the sustain electrode. This causes a drawback of instabilizing the address discharge generated in the address period, thereby reducing a driving efficiency of the plasma display panel.

SUMMARY OF THE INVENTION

Accordingly, an object of the present invention is to solve at least the problems and disadvantages of the background art.

An object of the present invention is to provide a plasma display apparatus and a driving method thereof, for suppressing reduction of a high temperature erroneous discharge.

Another object of the present invention is to provide a plasma display apparatus and a driving method thereof, for reducing noise generated in an address period, and improving a driving margin.

To achieve these and other advantages and in accordance with the purpose of the present invention, as embodied and broadly described, there is provided a plasma display apparatus comprising: a plasma display panel comprising a plurality of scan electrodes, sustain electrodes, and address electrodes intersecting with the scan electrodes; a scan driver for applying a negative waveform and a reset waveform subsequent to the negative waveform to the scan electrode, and applying a scan waveform subsequent to the reset waveform to the scan electrode; a sustain driver for applying a positive waveform corresponding to the negative waveform to the sustain electrode; and a data driver for applying an address waveform to the address electrode, wherein a scan waveform is applied to one scan electrode and applying time points among at least two address waveforms applied to the address electrode corresponding to the scan waveform are different from each other, wherein, when the temperature of the plasma display panel is more than a threshold temperature, an idle period from an applying time point of a last sustain waveform applied to the scan electrode or the sustain electrode to an applying time point of a predetermined waveform gets different.

In another aspect of the present invention, there is provided a plasma display apparatus comprising: a plasma display panel comprising a plurality of scan electrodes, sustain electrodes, and address electrodes intersecting with the scan electrodes; a scan driver for applying a negative waveform and a reset waveform subsequent to the negative waveform to the scan electrode, and applying a scan waveform subsequent to the reset waveform to the scan electrode; and a sustain driver for applying a positive waveform corresponding to the negative waveform to the sustain electrode, wherein, when the temperature of the plasma display panel is more than a threshold temperature, an idle period from an applying time point of a last sustain waveform applied to the scan electrode or the sustain electrode to an applying time point of a predetermined waveform gets different.

In a still another aspect of the present invention, there is provided a driving method of a plasma display apparatus having a plasma display panel comprising a plurality of scan electrodes, sustain electrodes, and address electrodes intersecting with the scan electrodes, the method comprising the steps of: applying a negative waveform to the scan electrode, and applying a positive waveform corresponding to the negative waveform, to the sustain electrode; and applying a reset waveform subsequent to the negative waveform to the scan electrode, applying a scan waveform subsequent to the reset waveform, applying an address waveform to the address electrode, wherein a scan waveform is applied to one scan electrode and applying time points among at least two address waveforms applied to the address electrode corresponding to the scan waveform are different from each other, wherein, when the temperature of the plasma display panel is more than a threshold temperature, an idle period from an applying time point of a last sustain waveform applied to the scan electrode or the sustain electrode to an applying time point of a predetermined waveform gets different.

The present invention has an effect of improving the plasma display apparatus and the driving method thereof, thereby suppressing a high temperature erroneous discharge of the plasma display panel.

The present invention has an effect of improving the plasma display apparatus and the driving method thereof, thereby reducing noise generated in an address period, and improving a driving margin.

The present invention has an effect of improving the plasma display apparatus and the driving method thereof, thereby sufficiently secure a driving period of a plasma display apparatus, and more stably driving the plasma display apparatus.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
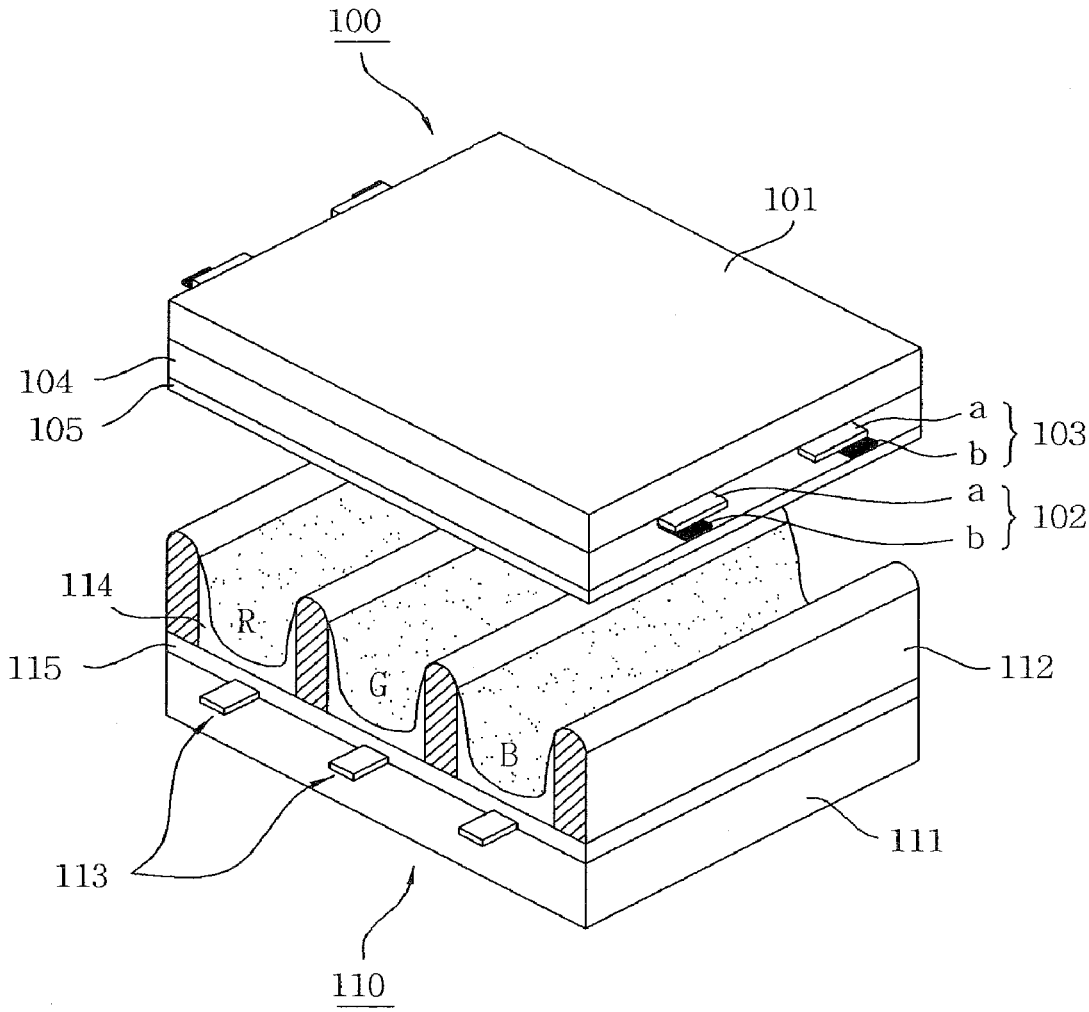
Fig. 1 Related Art
FIG. 1 illustrates a structure of a conventional plasma display panel.
Figure 2:
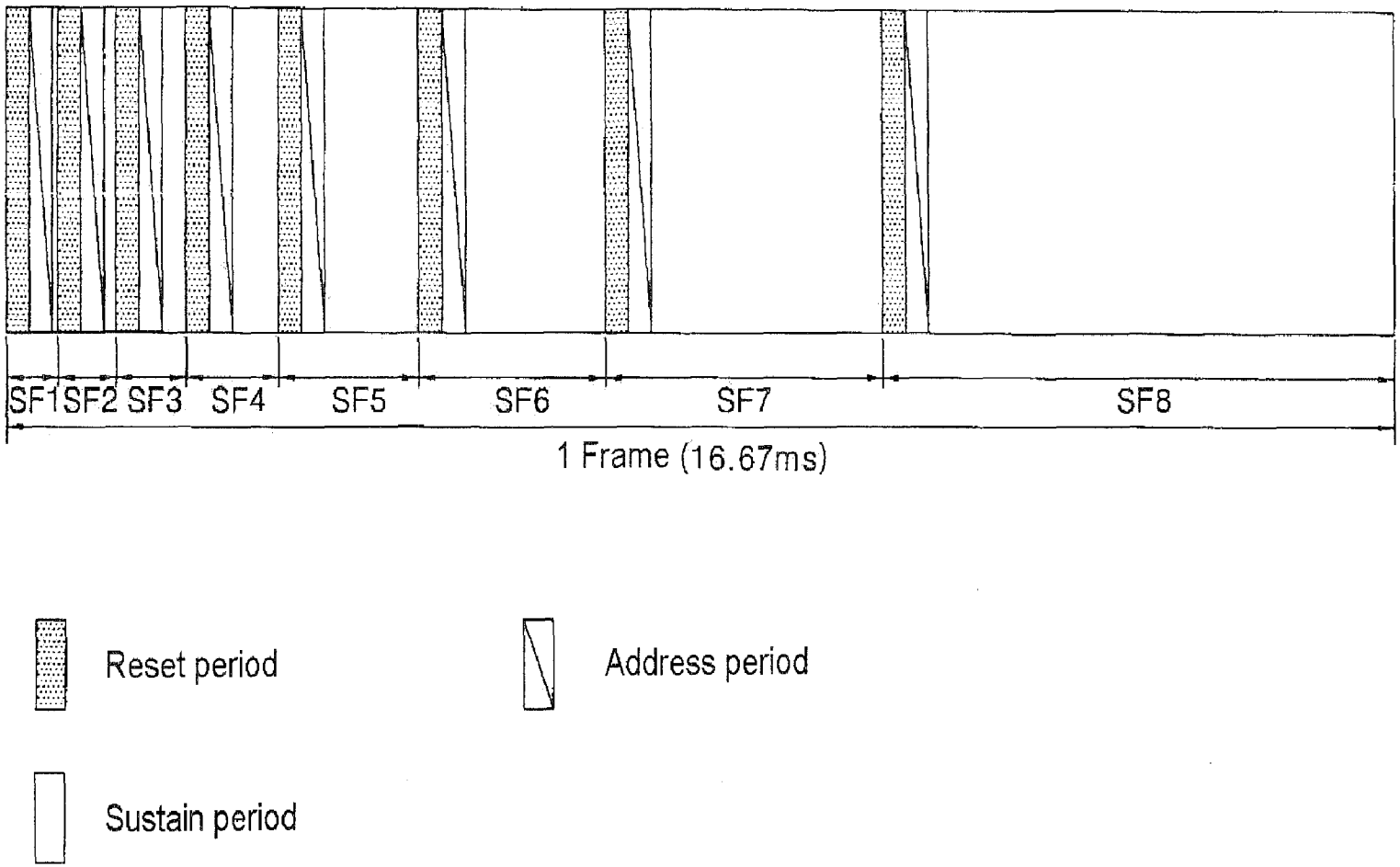
Fig. 2 Related Art
FIG. 2 illustrates a conventional method for expressing a gray level of an image in a plasma display apparatus.
Figure 3:
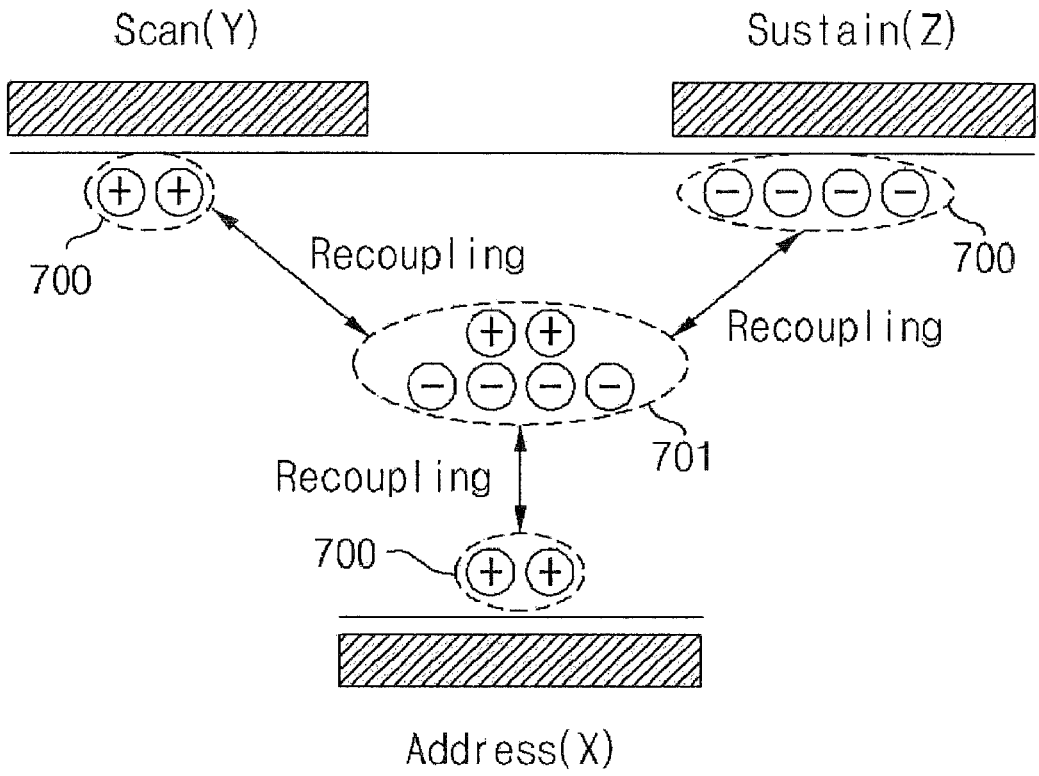
Fig. 3 Related Art
FIG. 3 illustrates a charge state within a conventional discharge cell.

Preferred embodiments of the present invention will be described in a more detailed manner with reference to the drawings.

In one aspect of the present invention, there is provided a plasma display apparatus comprising: a plasma display panel comprising a plurality of scan electrodes, sustain electrodes, and address electrodes intersecting with the scan electrodes; a scan driver for applying a negative waveform and a reset waveform subsequent to the negative waveform to the scan electrode, and applying a scan waveform subsequent to the reset waveform to the scan electrode; a sustain driver for applying a positive waveform corresponding to the negative waveform to the sustain electrode; and a data driver for applying an address waveform to the address electrode, wherein a scan waveform is applied to one scan electrode and applying time points among at least two address waveforms applied to the address electrode corresponding to the scan waveform are different from each other, wherein, when the temperature of the plasma display panel is more than a threshold temperature, an idle period from an applying time point of a last sustain waveform applied to the scan electrode or the sustain electrode to an applying time point of a predetermined waveform gets different.

The predetermined waveform may be any one of a setup waveform, a setdown waveform, or a scan waveform.

The scan driver may set a first threshold temperature and, when the temperature of the plasma display panel is more than the first threshold temperature, makes the idle period longer than when it is less than the first threshold temperature.

The first threshold temperature may be 40° C.

The idle period may be 100 μs to 1 ms.

The last sustain waveform may have a pulsewidth of 1 μs to 1 ms.

The address waveforms corresponding to the same scan waveforms and applied to the mutually different address electrodes may have mutually different applying time points.

The negative waveform is a ramp-down waveform, and the positive waveform may be constantly sustained.

In another aspect of the present invention, there is provided a plasma display apparatus comprising: a plasma display panel comprising a plurality of scan electrodes, sustain electrodes, and address electrodes intersecting with the scan electrodes; a scan driver for applying a negative waveform and a reset waveform subsequent to the negative waveform to the scan electrode, and applying a scan waveform subsequent to the reset waveform to the scan electrode; and a sustain driver for applying a positive waveform corresponding to the negative waveform to the sustain electrode, wherein, when the temperature of the plasma display panel is more than a threshold temperature, an idle period from an applying time point of a last sustain waveform applied to the scan electrode or the sustain electrode to an applying time point of a predetermined waveform gets different.

The scan driver may set a first threshold temperature and, when the temperature of the plasma display panel is more than the first threshold temperature, makes the idle period longer than when it is less than the first threshold temperature.

The first threshold temperature may be 40° C.

The idle period may be 100 μs to 1 ms.

The last sustain waveform may have a pulsewidth of 1 μs to 1 ms.

The negative waveform may be a ramp-down waveform, and the positive waveform may be constantly sustained.

another aspect of the present invention, there is provided a driving method of a plasma display apparatus having a plasma display panel comprising a plurality of scan electrodes, sustain electrodes, and address electrodes intersecting with the scan electrodes, the method comprising the steps of: applying a negative waveform to the scan electrode, and applying a positive waveform corresponding to the negative waveform, to the sustain electrode; and applying a reset waveform subsequent to the negative waveform to the scan electrode, applying a scan waveform subsequent to the reset waveform, applying an address waveform to the address electrode, wherein a scan waveform is applied to one scan electrode and applying time points among at least two address waveforms applied to the address electrode corresponding to the scan waveform are different from each other, corresponding to the scan waveforms, wherein, when the temperature of the plasma display panel is more than a threshold temperature, an idle period from an applying time point of a last sustain waveform applied to the scan electrode or the sustain electrode to an applying time point of a predetermined waveform gets different.

The idle period may be 100 μs to 1 ms.

The last sustain waveform may have a pulsewidth of 1 μs to 1 ms.

A detailed embodiment of the present invention will be described with reference to the attached drawings below.

First Embodiment

Figure 5:
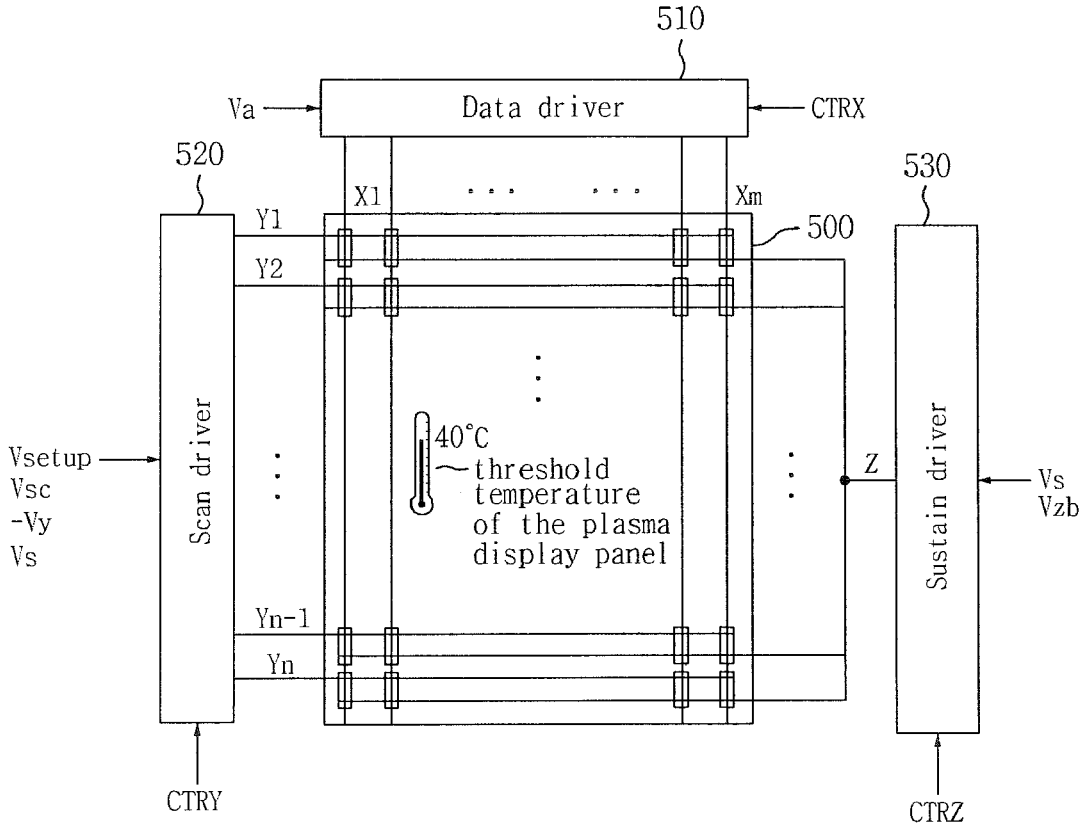
FIG. 5 illustrates a plasma display apparatus according to the first embodiment of the present invention.

FIG. 5 illustrates a plasma display apparatus according to the first embodiment of the present invention.

As shown in FIG. 5, the inventive plasma display apparatus comprises a plasma display panel 500, a data driver 510, a scan driver 520, and a sustain driver 530.

The plasma display panel 500 is formed by sealing front substrate (not shown) and a rear substrate (not shown). The front substrate has scan electrodes (Y1 to Yn) and a sustain electrode (Z), and the rear substrate has a plurality of address electrodes (X1 to Xm) intersecting with the scan electrodes (Y1 to Yn) and the sustain electrode (Z).

The data driver 510 applies data to the address electrodes (X1 to Xm) of the plasma display panel 500. The data refers to image signal data processed in an image signal processor (not shown) for processing an image signal received from the external. The data driver 510 samples and latches the data in response to a data timing control signal (CTRX) from a timing controller (not shown), and then applies an address waveform having an address voltage (Va) to each of the address electrodes (X1 to Xm). In the first embodiment of the present invention, at least two address waveforms having different applying time points corresponding to the scan waveforms are applied to the address electrodes. In other words, the applying time point of the address waveform applied to the address electrode can be controlled, thereby reducing noise generated in the address period. This will be in detail described later with reference to FIGS. 8A to 12A.

The scan driver 520 drives the scan electrodes (Y1 to Yn) of the plasma display panel 500. The scan driver 520 applies a setup waveform having a ramp-up formed by a combination of a sustain voltage (Vs) and a setup voltage (Vsetup), during a setup period of the reset period in response to a scan timing control signal (CTRY) from the timing controller (not shown). After that, the scan driver 520 applies a ramp-down setdown waveform consequently to the setup waveform, to the scan electrodes (Y1 to Yn) during a setdown period of the reset period. After that, the scan driver 520 sequentially applies a scan waveform with a scan voltage (−Vy) to a scan reference voltage (Vsc), to each of the scan electrodes (Y1 to Yn) during an address period. After that, the scan driver 520 applies at least one sustain waveform with a ground level (GND) to the sustain voltage (Vs) for a display discharge, to the scan electrodes (Y1 to Yn) during the sustain period.

The sustain driver 530 drives the sustain electrode (Z) formed as a common electrode in the plasma display panel 500. The sustain driver 530 applies a waveform having a positive bias voltage (Vzb), to the sustain electrode (Z) during the address period in response to a scan timing control signal (CTRZ) from the timing controller (not shown). After that, the sustain driver 530 applies at least one sustain waveform with the ground level (GND) to the sustain voltage (Vs), to the sustain electrode (Z) during the sustain period.

In the first embodiment of the present invention, an idle period from an applying time point of the sustain waveform applied to the scan electrodes (Y1 to Yn) or the sustain electrode (Z) to an applying time point of a predetermined waveform gets different depending on a temperature of the plasma display panel 500. The predetermined waveform being any one of the setup waveform, the setdown waveform, and the scan waveform, is a waveform initially applied at a next frame after a last sustain waveform is applied. In other words, the idle period is defined as a period from an applying time point of a last sustain waveform of a current frame to a time point where a next frame is initiated. As such, the idle period can be controlled depending on the temperature of the plasma display panel 500, thereby suppressing a high temperature erroneous discharge. This will be in detail described with reference to FIGS. 6 and 7 below.

Figure 6:
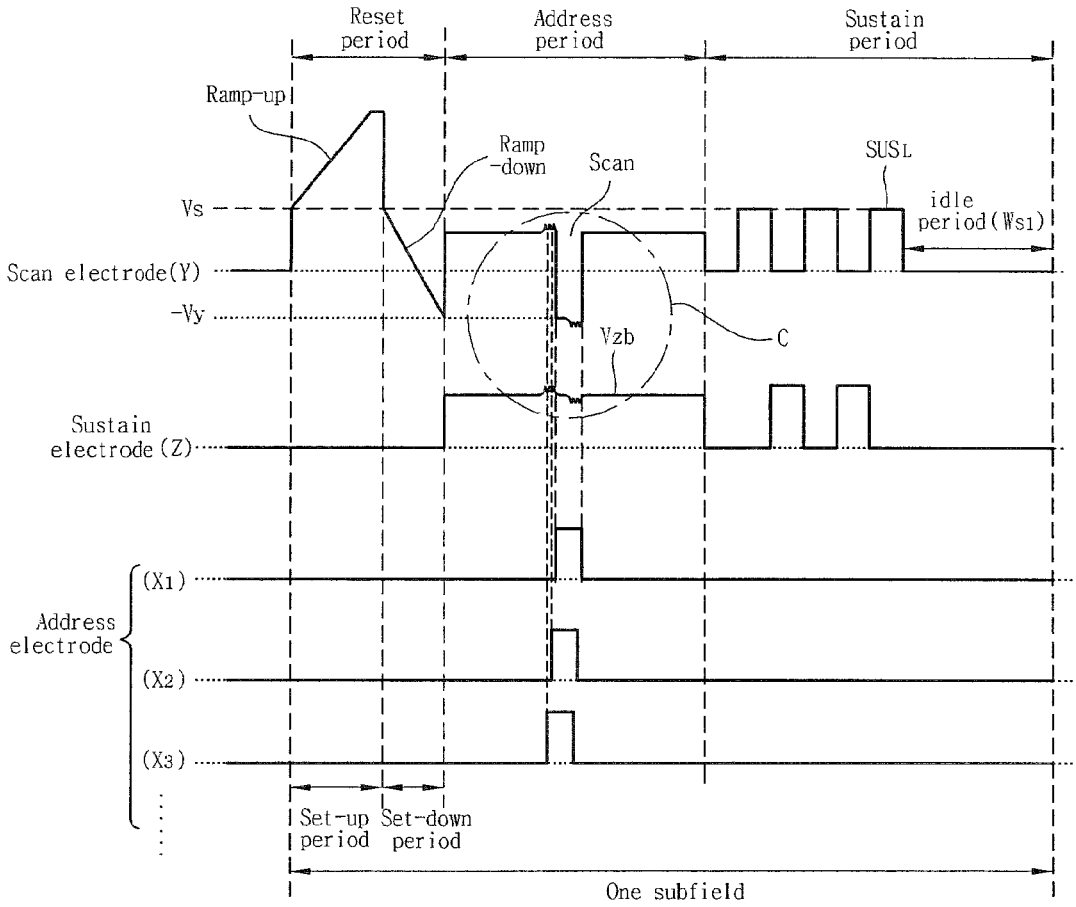
FIG. 6 illustrates a driving waveform according to the first embodiment of the present invention.

FIG. 6 illustrates a driving waveform according to the first embodiment of the present invention.

As shown in FIG. 6, the inventive plasma display apparatus is driven with each subfield divided into the reset period for initializing all cells, the address period for selecting a cell to be discharged, and the sustain period for sustaining a discharge of the selected cell.

In the setup period of the reset period, the ramp-up setup waveform is concurrently applied to all scan electrodes. By the setup waveform, a weak dark discharge is generated within discharge cells of a whole screen. By the setup discharge, positive wall charges are accumulated on the address electrode and the sustain electrode, and negative wall charges are accumulated on the scan electrode.

In the setdown period, the setdown waveform falling from the ground level (GND) to a predetermined voltage (−Vy) level is applied to all scan electrodes. Accordingly, an erasure discharge is generated between the scan electrode and the address electrode within the cells, thereby sufficiently erasing the wall charges formed between the scan electrode and the address electrode. By the setdown waveform, the wall charges of such an amount that an address discharge can be stably generated within the cells where an image is to be displayed in the sustain period uniformly remain within the cells. In other words, a second falling waveform performs a function similar with a conventional setdown waveform.

In the address period, a negative scan waveform is sequentially applied to the scan electrodes and at the same time, is synchronized to the scan waveform so that a positive address waveform is applied to the address electrode. A potential difference between the scan waveform and the address waveform and a wall voltage generated in the reset period are added, thereby generating the address discharge within the discharge cell to which the address waveform is applied. Within the cells selected by the address discharge, the wall charges are formed in such an amount that a discharge can be generated when the sustain waveform of the sustain voltage (Vs) level is applied. A waveform having the positive bias voltage (Vzb) is applied to the sustain electrode to reduce a potential difference with the scan electrode during the address period, thereby not generating erroneous discharge with the scan electrode. In the first embodiment of the present invention, at least two address waveforms having different applying time points corresponding to the scan waveform are applied in the address period of one subfield.

In the sustain period, the positive sustain waveform (Sus) is alternately applied to the scan electrode and the sustain electrodes. As the wall voltage within the cell and a voltage of the sustain voltage are added, the cell selected by the address discharge generates the sustain discharge between the scan electrode and the sustain electrode, that is, the display discharge whenever the sustain waveform is applied.

In the first embodiment of the present invention, in the address period of one subfield, at least two address waveforms having different applying time points corresponding to the scan waveform are applied and together with this, the idle period gets different depending on the temperature of the plasma display panel. In FIG. 6, the idle period is a period (WS1) for sustaining the ground level (GND) after the last one (SUSL) of the sustain waveforms applied in the sustain period falls from the sustain voltage (Vs) to the ground level (GND).

The idle period is preferably 100 μs to 1 ms. The space charges within the discharge cell that mainly causes the high temperature erroneous discharge within a range of 100 μs to 1 ms can be effectively reduced. In other words, in the sustain period, a period from a time point of generating the last sustain discharge to a time point of initiating a next subfield is set to sufficiently get long, thereby securing a time enough to reduce the space charges after the last sustain discharge. Here, a reason of setting a lower limit threshold value to 100 μs is to sufficiently reduce the space charges generated in the sustain discharge of the plasma display apparatus, and a reason of setting an upper limit threshold value to 1 ms is to secure an operation margin of the sustain period of the plasma display apparatus.

Such the idle period gets longer as the plasma display panel increases in temperature. This is because as the temperature of the plasma display panel increases, the space charges of the discharge cell increase. Preferably, the scan driver sets a first threshold temperature, and controls the idle period when the temperature of the plasma display panel exceeds the first threshold temperature to be longer than the idle period when it is less than the first threshold temperature. At this time, the first threshold temperature is 40° C. In the first embodiment of the present invention, a high temperature being a factor of having influence on driving of the plasma display apparatus, that is, the first threshold temperature is set to 40° C., but when the plasma display apparatus is variously changed in structure, the first threshold temperature is variable. In addition to the first threshold temperature, a plurality of threshold values such as second and third threshold temperatures together with the first threshold temperature can be also set to stepwise change the idle period depending on the temperature of the plasma display panel.

Meantime, the subfield where the idle period is controlled can be arbitrarily selected within one frame. In other words, considering a characteristic of the plasma display apparatus capable of controlling a driving waveform of each of plural subfields constituting one frame, at least one subfield is selected to control the idle period in order to more effectively reduce the high temperature erroneous discharge and secure a margin of a driving period. For example, it is possible to detect a subfield where the space charges are more generated in amount as the temperature increases, and concentratively increase the idle period of the subfield.

In FIG. 6, the driving waveform is sustained to be at the ground level (GND) in the idle period, thereby reducing the space charges, but it is possible to differently apply the driving waveform as in FIG. 7 below.

Figure 7:
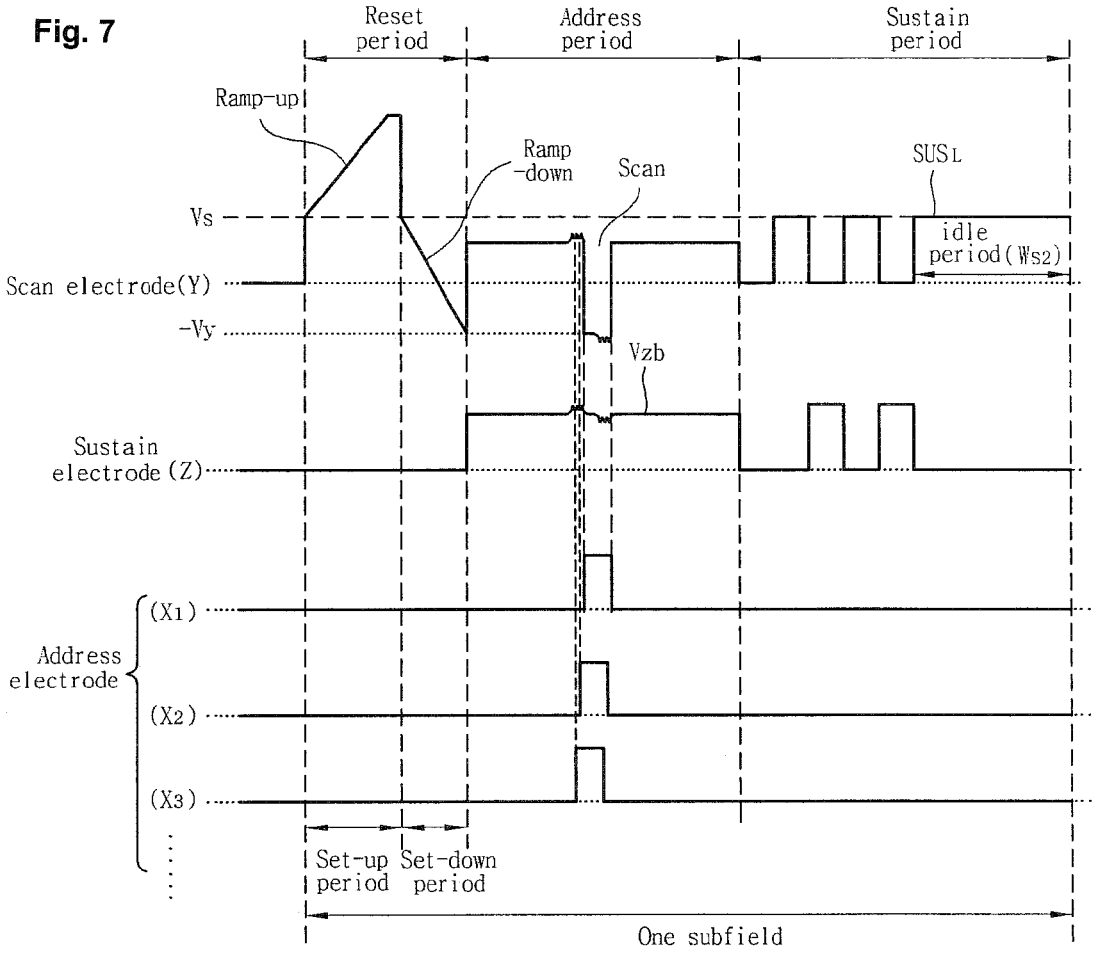
FIG. 7 illustrates other driving waveforms according to the first embodiment of the present invention.

FIG. 7 illustrates other driving waveforms according to the first embodiment of the present invention.

As shown in FIG. 7, other driving waveforms of the plasma display apparatus are also divided on the basis of the reset period for initializing all cells, the address period for selecting the cell to be discharged, and the sustain period for sustaining the discharge of the selected cell. At this time, in the address period, at least two address waveforms having different applying time points corresponding to the scan waveform in the address period of one subfield are applied. A description of each period is enough made in FIG. 6 and accordingly, will be omitted.

In other driving waveforms of the plasma display apparatus, the high temperature erroneous discharge is suppressed by controlling a supply period of the sustain waveform for generating the last sustain discharge in the idle period. In other words, a period where the last sustain waveform sustains the sustain voltage (Vs) is an idle period (Ws2). The idle period is preferably controlled within a range of 1 μs to 1 ms. The reason of setting the lower limit threshold value to 1 μs is to generate a sustain discharge of a desired magnitude, and a reason of setting the upper limit threshold value to 1 ms is to sufficiently reduce the space charges generated in the sustain discharge and concurrently, secure the operation margin of the sustain period of the plasma display apparatus. Even in other driving waveforms according to the first embodiment of the present invention, it is possible to differently set the idle period by setting the threshold temperature. Further, as described above, at least any one of plural subfields can be selected to control the idle period.

Meantime, a method for applying the at least two address waveforms having the different applying time points corresponding to the scan waveform can be variously modified. First, a method for applying the address waveform at a different applying time point from the scan waveform to each of a plurality of address electrodes will be described with reference to FIGS. 8A to 8E.

FIGS. 8A to 8E illustrate the driving waveforms of the address period according to the first embodiment of the present invention.

Figure 8A:
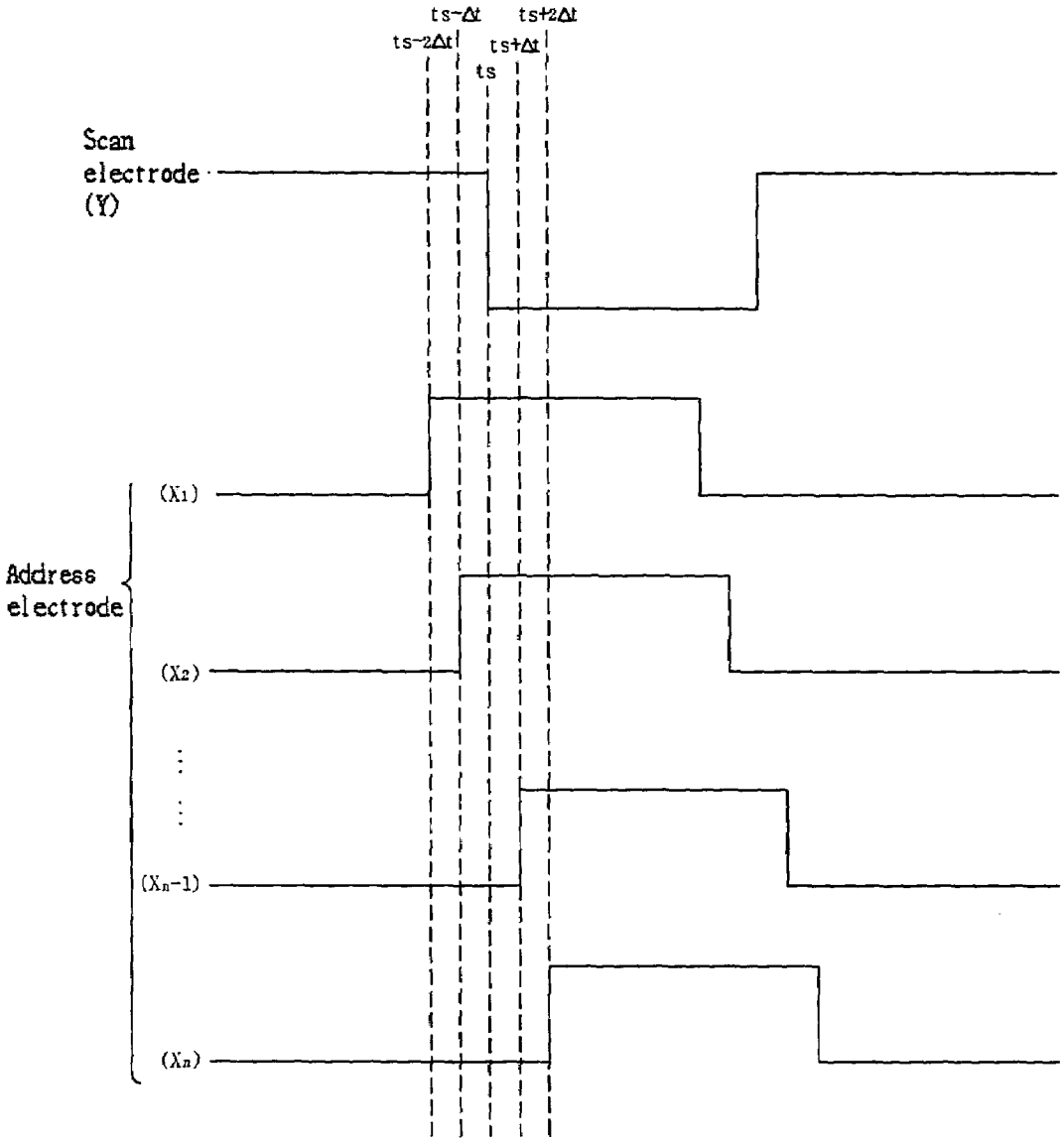
FIGS. 8A to 8E illustrate driving waveforms of an address period according to the first embodiment of the present invention.

As shown in FIG. 8A, in the driving waveform of the address period according to the first embodiment of the present invention, at least two address waveforms are earlier or later applied corresponding to the scan waveform. For example, as in FIG. 8A, assuming that the applying time point of the scan waveform applied to the scan electrode (Y) is "ts", the address waveform is applied to the address electrode (X1) at a time point earlier by 2Δt than a time point at which the scan waveform is applied to the scan electrode (Y), that is, at a time point "ts−2Δt" adaptively to an arrangement sequence of the address electrodes (X1 to Xn). The address waveform is applied to the address electrode (X2) at a time point earlier by Δt than a time point at which the scan waveform is applied to the scan electrode (Y), that is, at a time point "ts−Δt". By this method, the address waveform is applied to the electrode (Xn−1) at a time point "ts+Δf", and the address waveform is applied to the electrode (Xn) at a time point "ts+2Δt". In other words, as shown in FIG. 8A, the address waveform is applied to the address electrodes (X1 to Xn) before or after the applying time point of the scan waveform applied to the scan electrode (Y).

Figure 8B:
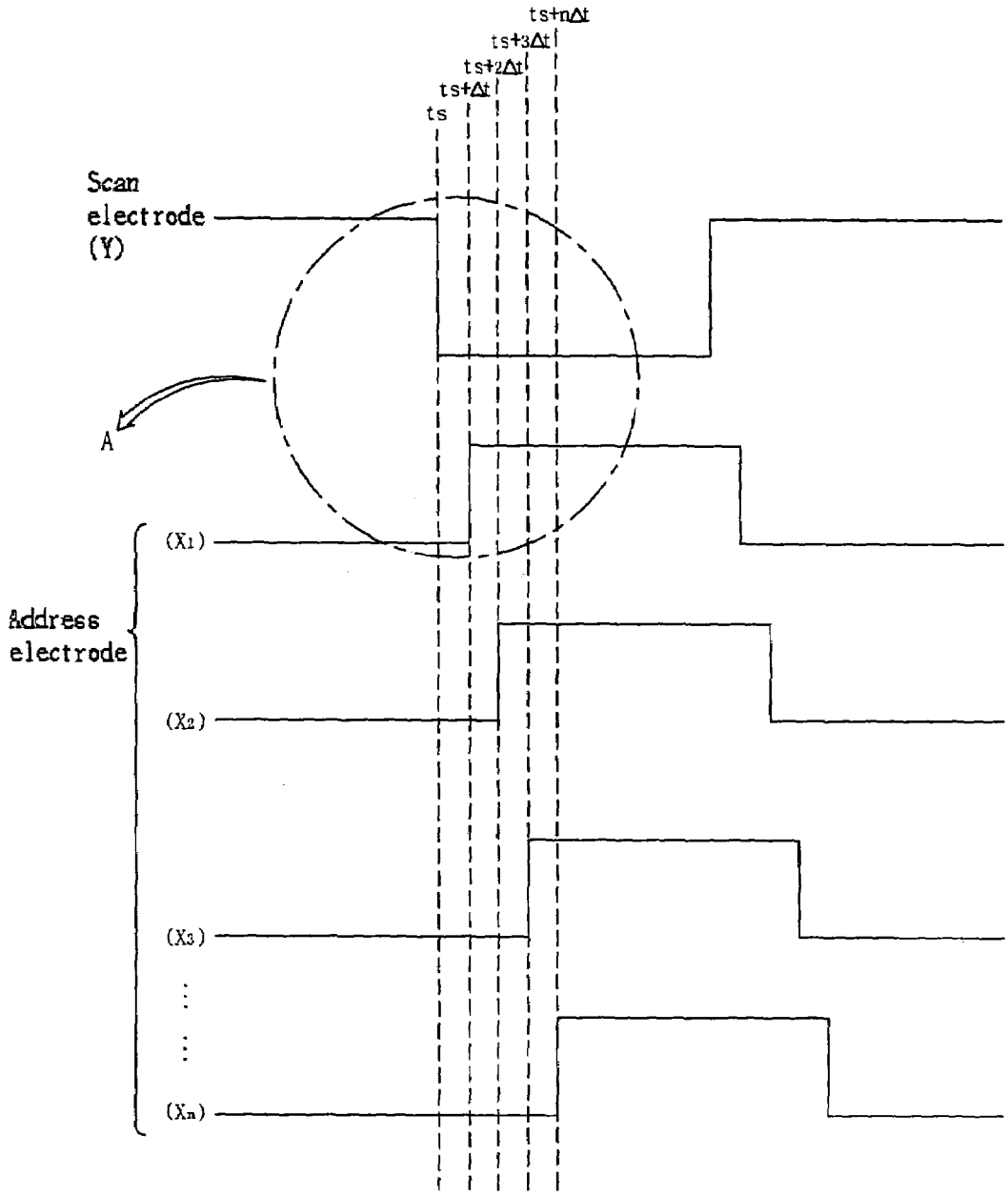

As shown in FIG. 8B, in the driving waveform of the address period according to the first embodiment of the present invention, the applying time points of the address waveforms applied to the address electrodes (X1 to Xn) are later than the applying time point of the scan waveform applied to the scan electrode (Y). For example, as in FIG. 8B, assuming that the applying time point of the scan waveform applied to the scan electrode (Y) is "ts", the address waveform is applied to the address electrode (X1) at a time point later by Δt than a time point at which the scan waveform is applied to the scan electrode (Y), that is, at a time point "ts+Δt" adaptively to an arrangement sequence of the address electrodes (X1 to Xn). The address waveform is applied to the address electrode (X2) at a time point later by 2Δt than a time point at which the scan waveform is applied to the scan electrode (Y), that is, at a time point "ts+2Δt". By this method, the address waveform is applied to the address electrode (X3) at a time point "ts+3Δt", and the address waveform is applied to the electrode (Xn) at a time point "ts+nΔt".

Figure 8C:
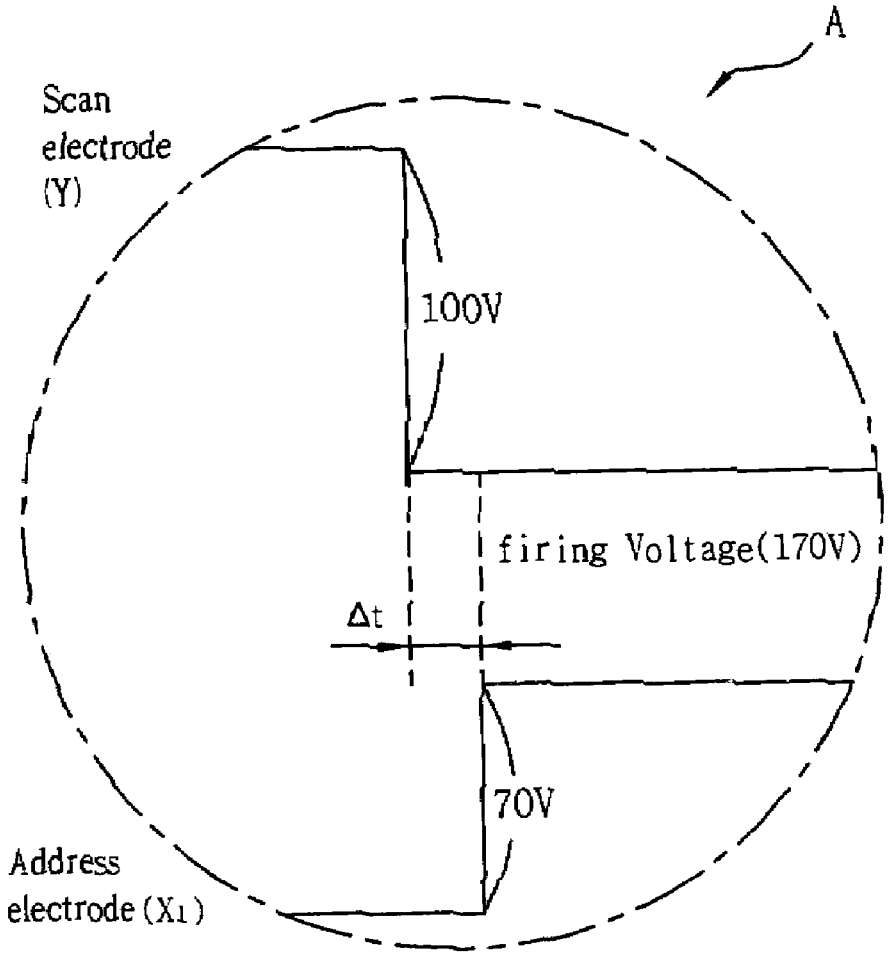

In a description of a region 'A' of FIG. 8B referring to FIG. 8C, for example, assuming that an address discharge firing voltage is 170V, the scan waveform has a voltage of 100V, and the address waveform has a voltage of 70V, in the region 'A', first, a voltage difference between the scan electrode (Y) and the address electrode (X1) becomes 100V by the scan waveform applied to the scan electrode (Y), and after a time "Δt" lapses after the applying of the scan waveform, a voltage difference between the scan electrode (Y) and the address electrode (X1) rises to 170V by the address waveform applied to the address electrode (X1).

Accordingly, the voltage difference between the scan electrode (Y) and the address electrode (X1) becomes an address discharge firing voltage, thereby generating the address discharge between the scan electrode (Y) and the address electrodes (X1 to Xn). After that, the address waveform can be sequentially applied to a next address electrode, thereby reducing noise generated in the waveform applied to the scan electrode or the sustain electrode. Together with this, as the address discharge is sequentially generated, a more stable driving can be performed.

Figure 8D:
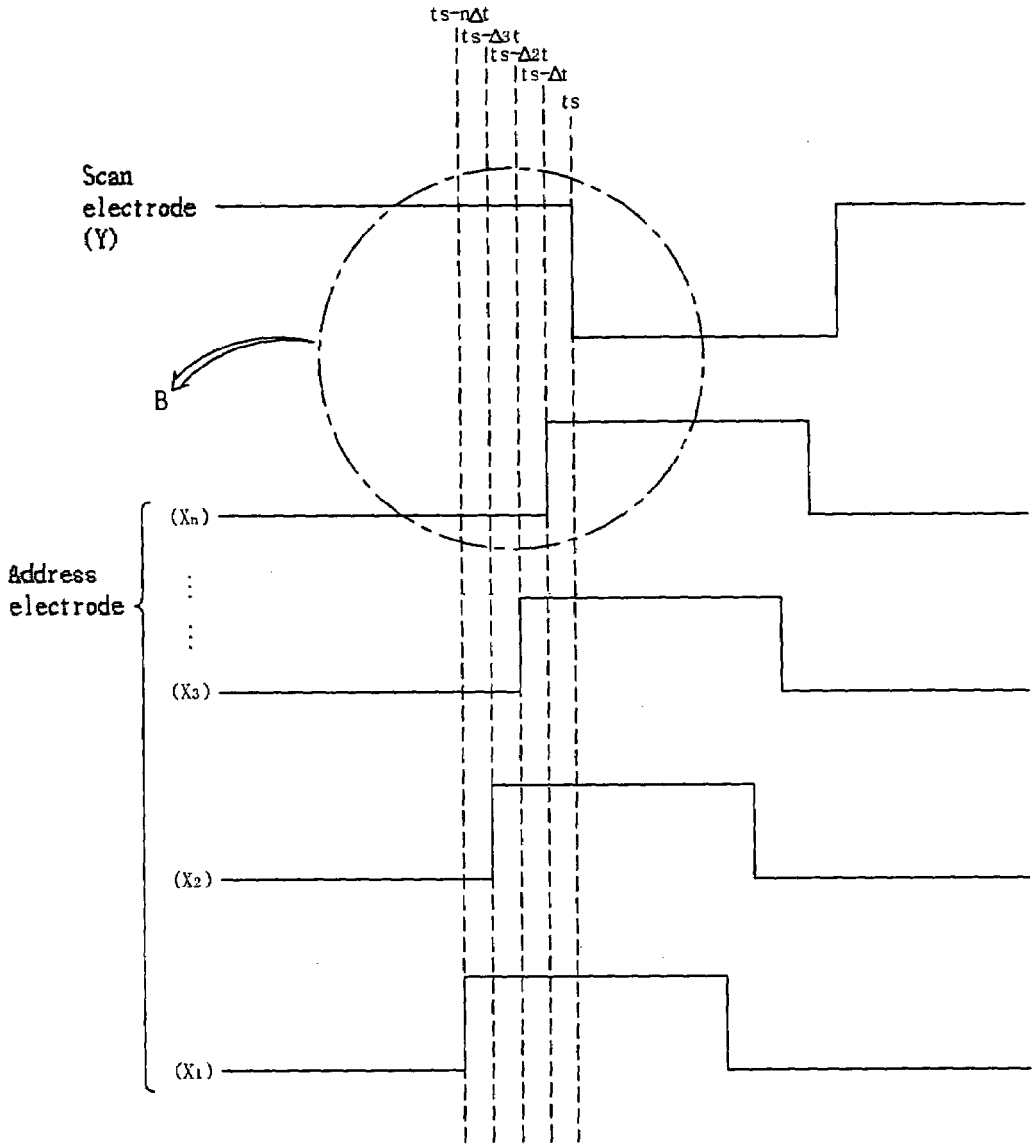

As shown in FIG. 8D, in the driving waveform of the address period according to the first embodiment of the present invention, the applying time points of the address waveforms applied to the address electrodes (X1 to Xn) are earlier than the applying time point of the scan waveform applied to the scan electrode (Y). For example, as in FIG. 8D, assuming that the applying time point of the scan waveform applied to the scan electrode (Y) is "ts", the address waveform is applied to the address electrode (X1) at a time point later by Δt than a time point at which the scan waveform is applied to the scan electrode (Y), that is, at a time point "ts−Δt" adaptively to an arrangement sequence of the address electrodes (X1 to Xn). The address waveform is applied to the address electrode (X2) at a time point earlier by 2Δt than a time point at which the scan waveform is applied to the scan electrode (Y), that is, at a time point "ts−2Δt". By this method, the address waveform is applied to the address electrode (X3) at a time point "ts−3Δt", and the address waveform is applied to the electrode (Xn) at a time point "ts−nΔt".

Figure 8E:
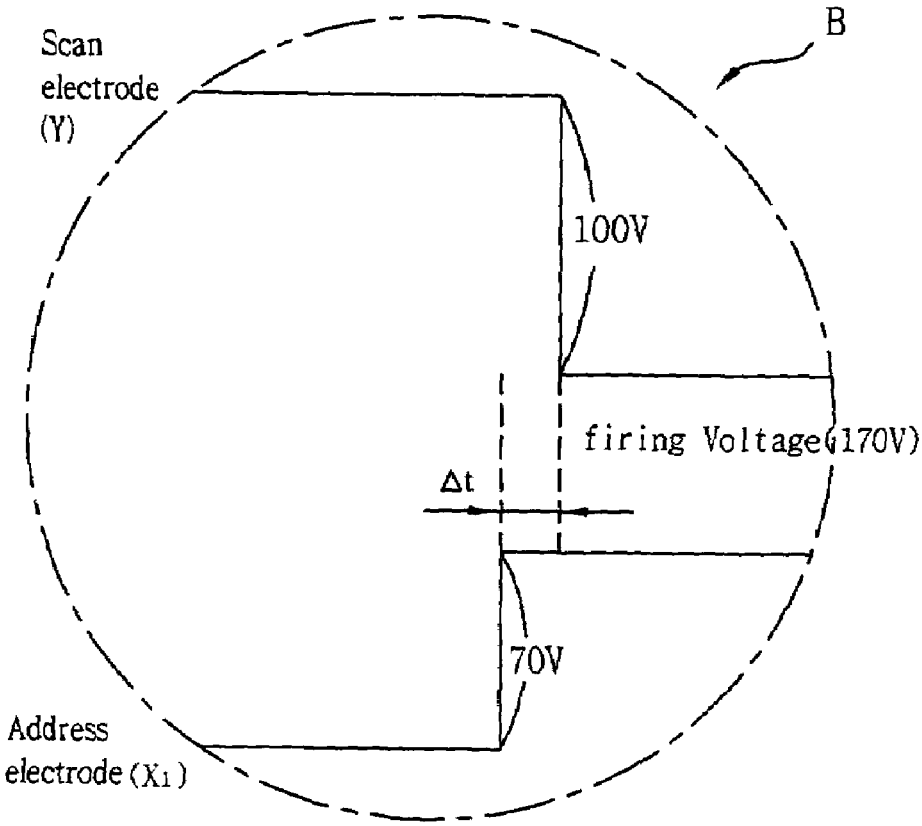

In a description of a region 'B' of FIG. 8B referring to FIG. 8E, for example, assuming that an address discharge firing voltage is 170V, the scan waveform has a voltage of 100V, and the address waveform has a voltage of 70V, in the region 'B', first, a voltage difference between the scan electrode (Y) and the address electrode (X1) becomes 100V by the scan waveform applied to the scan electrode (Y), and after a time "Δt" lapses after the applying of the scan waveform, a voltage difference between the scan electrode (Y) and the address electrode (X1) rises to 170V by the address waveform applied to the address electrode (X1).

Accordingly, the voltage difference between the scan electrode (Y) and the address electrode (X1) becomes an address discharge firing voltage, thereby generating the address discharge between the scan electrode (Y) and the address electrodes (X1 to Xn). After that, the address waveform can be sequentially applied to a next address electrode, thereby reducing noise generated in the waveform applied to the scan electrode or the sustain electrode. Together with this, as the address discharge is sequentially generated, a more stable driving can be performed.

In FIGS. 8A to 8E, a difference between the applying time point of the scan waveform applied to the scan electrode (Y) and the applying time points of the address waveforms applied to the address electrodes (X1 to Xn) or a difference between the applying time points of the address waveforms applied to the address electrodes (X1 to Xn) are described on the basis of a concept of Δt. In a description of the Δt, for example, the applying time point of the scan waveform applied to the scan electrode (Y) is "ts", a difference between the applying time point (ts) of the scan waveform and the applying time point of the address waveform being most proximate with the applying time point (ts) is "Δt", and a difference between the applying time point (ts) of the scan waveform and the applying time point of the address waveform being subsequently proximate with the applying time point (ts) is twice of Δt, that is, 2Δt.

The Δt is constantly sustained. In other words, the applying time point of the scan waveform applied to the scan electrode (Y) is different from the applying time points of the address waveforms applied to the address electrodes (X1 to Xn), respectively, while the differences between the applying time points of the address waveforms applied to the address electrodes (X1 to Xn) are the same as one another, respectively.

Further, within one subfield, the differences between the applying time points of the address waveforms applied to the address electrodes (X1 to Xn) are made to be the same as one another, respectively while the difference between the applying time point of the scan waveform and the applying time point of the address waveform being the most proximate with the applying time point of the scan waveform can be also made to be the same as or different from one another.

For example, if in one subfield, the differences between the applying time points of the address waveforms applied to the address electrodes (X1 to Xn) are made to be the same as one another, respectively while, in any one address period, the difference between the applying time point (ts) of the scan waveform and the applying time point of the address waveform being most proximate with the applying time point (ts) is "Δt", in other address period of the same subfield, the difference between the applying time point (ts) of the scan waveform and the applying time point of the address waveform being most proximate with the applying time point (ts) is "2Δt".

In the first embodiment of the present invention, the applying time point of the scan waveform and the applying time point of the address waveform are different from each other while the difference between the applying time points of the address waveforms can be also different from one another, respectively. For example, assuming that the applying time point of the scan waveform applied to the scan electrode (Y) is "ts", and the difference between the applying time point (ts) of the scan waveform and the applying time point of the address waveform being most proximate with the applying time point (ts) is "Δt", the difference between the applying time point (ts) of the scan waveform and the applying time point of the address waveform being subsequently proximate with the applying time point (ts) can be also "3Δt".

For example, if the applying time point at which the scan waveform is applied to the scan electrode (Y) is 0 ns, the address waveform is applied to the address electrode (X1) at a time point of 10 ns. Accordingly, the difference between the applying time point of the scan waveform applied to the scan electrode (Y) and the applying time point of the address waveform applied to the address electrode (X1) is 10 ns.

The address waveform is applied to a next address electrode (X2) at a time point of 20 ns so that the difference between the applying time point of the scan waveform applied to the scan electrode (Y) and the applying time point of the address waveform applied to the address electrode (X2) is 20 ns and accordingly, the difference between the applying time point of the address waveform applied to the address electrode (X1) and the applying time point of the address waveform applied to the address electrode (X2) is 10 ns.

The address waveform is applied to a next address electrode (X3) at a time point of 40 ns so that the difference between the applying time point of the scan waveform applied to the scan electrode (Y) and the applying time point of the address waveform applied to the address electrode (X3) is 40 ns and accordingly, the difference between the applying time point of the address waveform applied to the address electrode (X2) and the applying time point of the address waveform applied to the address electrode (X3) is 20 ns.

In other words, the applying time point of the scan waveform applied to the scan electrode (Y) and the applying time point of the address waveform applied to the address electrode (X1 to Xn) are different from one another while the difference between the applying time points of the address waveforms applied to the address electrodes (X1 to Xn) can be also set to be different from one another, respectively.

Here, the difference (Δt) between the applying time point of the scan waveform applied to the scan electrode (Y) and the applying time points of the address waveforms applied to the address electrodes (X1 to Xn) is more than 10 ns, and is preferably set to be less than 1000 ns.

In the address period, the applying time point of the scan waveform applied to the scan electrode (Y) is different from the applying time points of the address waveforms applied to the address electrodes (X1 to Xn), thereby reducing coupling through a capacitance of the panel at each applying time point of the address waveform applied to the address electrodes (X1 to Xn), and reducing noise of the waveform applied to the scan electrode and the sustain electrode. This noise reduction will be described with reference to FIG. 9 below.

Figure 9:
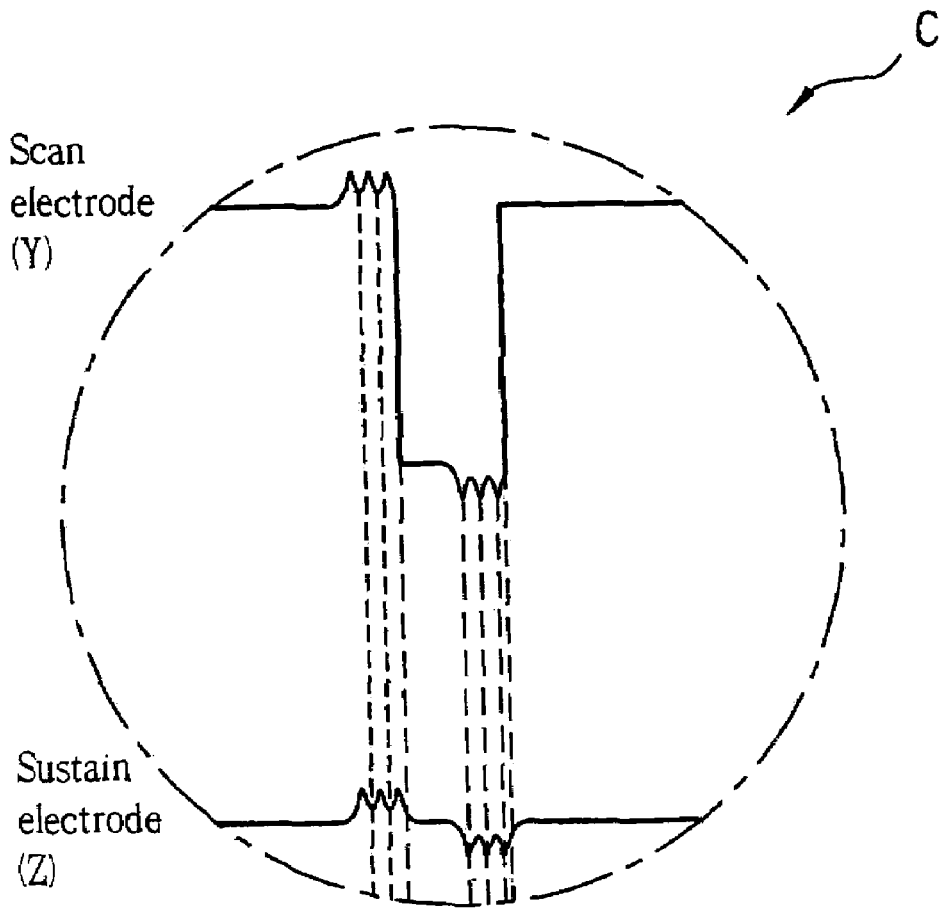
FIG. 9 illustrates a region 'C' of FIG. 6.

FIG. 9 illustrates a region 'C' of FIG. 6.

Figure 4:
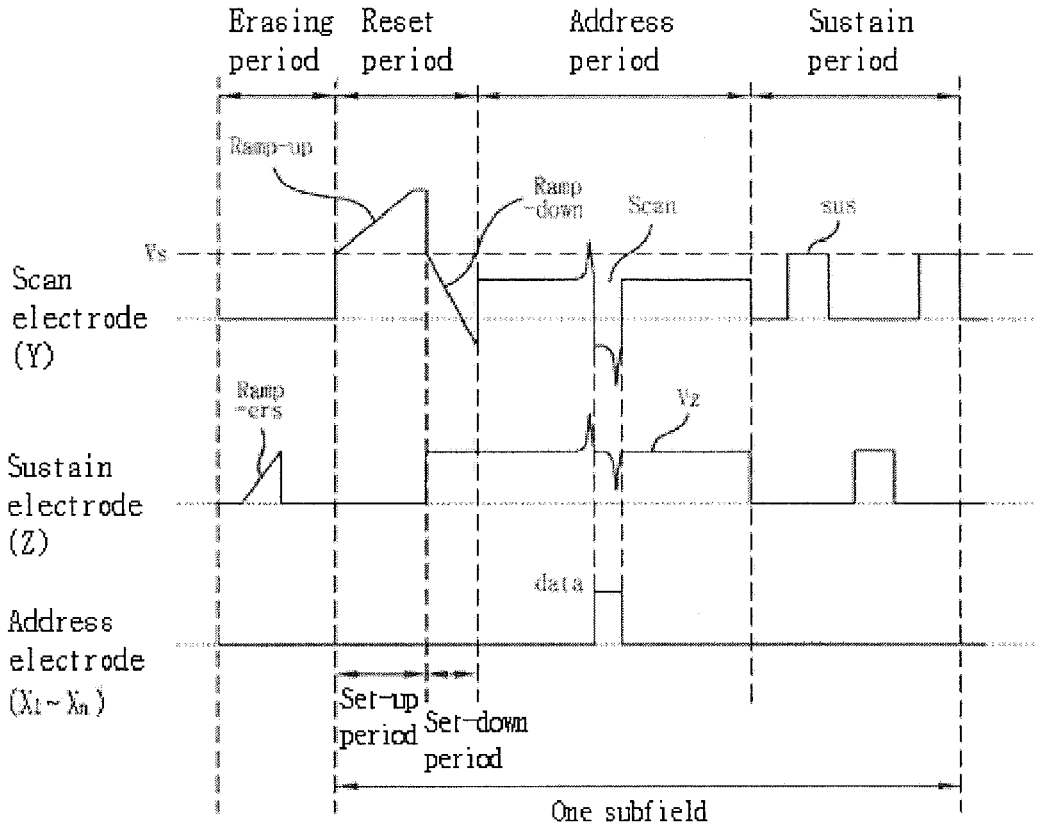
Fig. 4 Related Art
FIG. 4 illustrates a driving waveform of a conventional plasma display apparatus.

In FIG. 9 being an exploded view of the region 'C' of FIG. 6, it can be understood that the noises of the waveforms applied to the scan electrode and the sustain electrode is reduced in much amount in comparison to FIG. 4. The address waveform can be applied to each of the address electrodes (X1 to Xn) at a time point different from the applying time point of the scan waveform, thereby reducing the coupling through the capacitance of the panel at each time point. Accordingly, at a time point at which the address waveform abruptly rises, a rising noise generated from the waveform applied to the scan electrode and the sustain electrode is reduced, and at a time point at which the address waveform abruptly falls, a falling noise generated from the waveform applied to the scan electrode and the sustain electrode is reduced. By this, the address discharge generated in the address period is stabilized, thereby suppressing reduction of driving stabilization of the plasma display apparatus. Further, the address discharge is stabilized, thereby making it possible to employ a single scan method where a whole panel is scanned with one driver. The single scan method refers to a driving method in which the applying time points of the scan waveforms applied to the plurality of scan electrodes provided for a display region of a front panel are differentiated at each of the plurality of the scan electrodes.

Meantime, it is possible that at least any one of the address waveforms applied to the address electrodes (X1 to Xn) is applied at the same time point as those of at least two to (n−1) or less ones of the address electrodes (X1 to Xn). This will be described with reference to FIGS. 10A to 10C below.

Figure 10A:
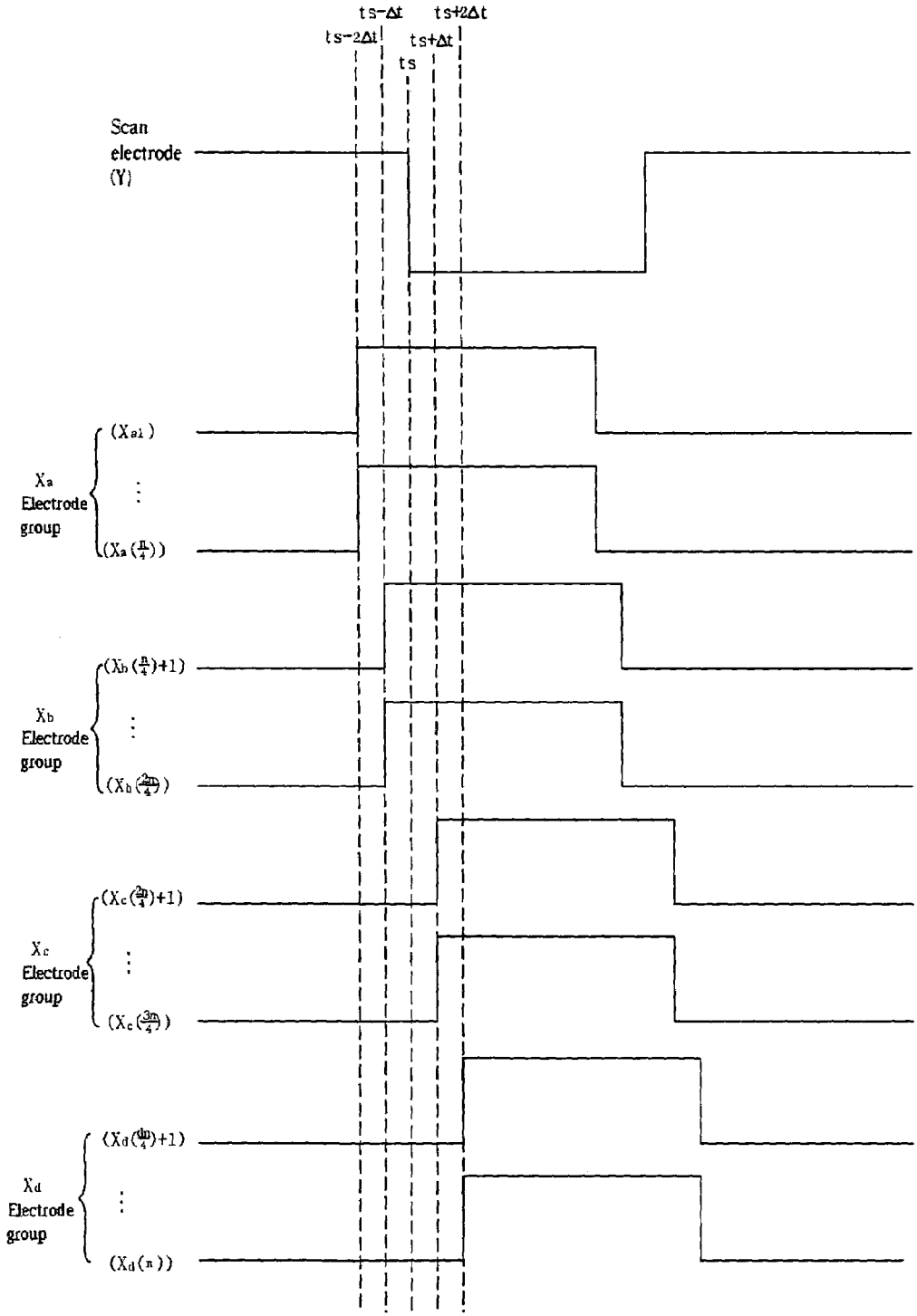
FIGS. 10A to 10C illustrate other driving waveforms of an address period according to the first embodiment of the present invention.
Figure 10B:
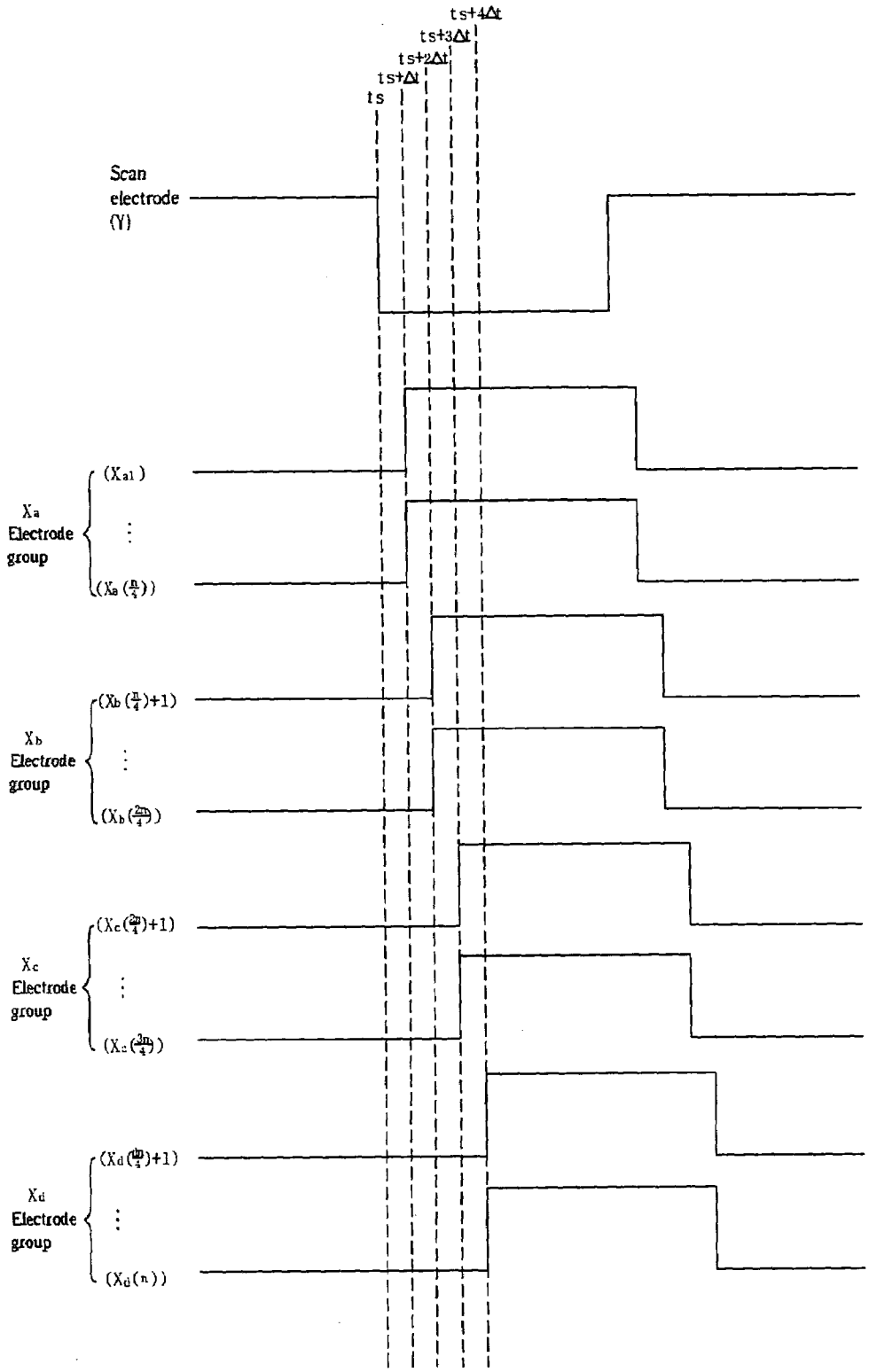
Figure 10C:
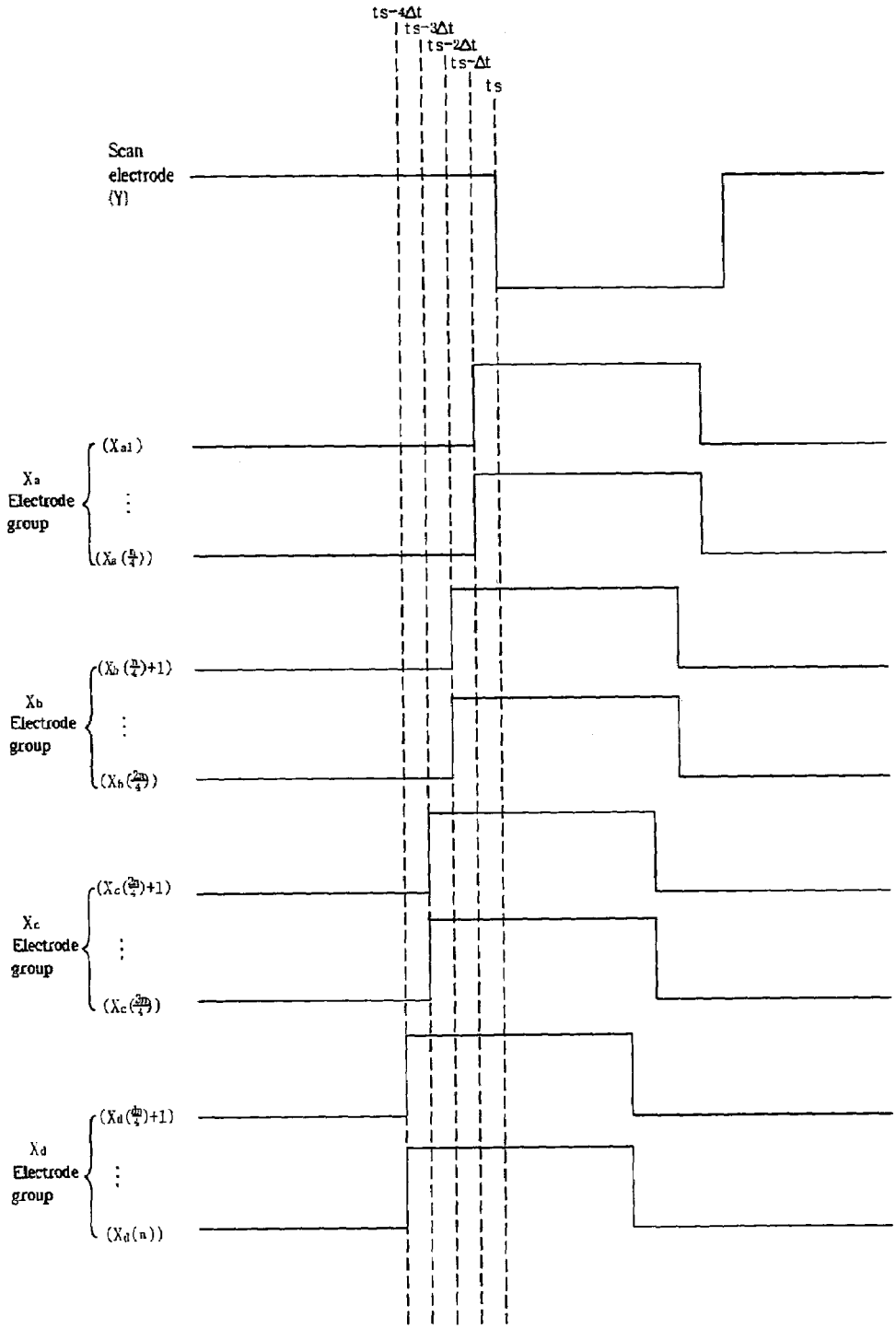

FIGS. 10A to 10C illustrate other driving waveforms of the address period according to the first embodiment of the present invention.

As shown in FIGS. 10A to 10C, in other driving waveforms of the address period according to the first embodiment of the present invention, the plurality of address electrodes (X1 to Xn) is divided as a plurality of address electrode groups (an Xa electrode group, an Xb electrode group, an Xc electrode group, and an Xd electrode group), and the applying time points of the address waveforms applied to at least two address electrode groups are different with each other, and the applying time point of the address waveform applied to at least one address electrode group is different from the applying time point of the scan waveform applied to the scan electrode (Y). By this, the address discharge is prevented from being instabilized, thereby suppressing the reduction of the driving stability. Accordingly, the driving efficiency is enhanced.

As shown in FIG. 10A, assuming that the applying time point of the scan waveform applied to the scan electrode (Y) is "ts", the address waveforms are applied to the address electrodes (Xa1 to Xa(n)/4) at a time point earlier by 2Δt than a time point at which the scan waveform is applied to the scan electrode (Y), that is, at a time point "ts−2Δt" adaptively to an arrangement sequence of the address electrode groups comprising the address electrodes (X1 to Xn). The address waveforms are applied to the address electrode (Xb{(n/4)+1} to Xb(2n)/4) comprised in the electrode group (Xb) at a time point earlier by Δt than a time point at which the scan waveform is applied to the scan electrode (Y), at a time point "ts−Δt". By this method, the address waveforms are applied to the address electrodes (Xc{(2n/4)+1} to Xc(3n)/4) comprised in the electrode group (Xc) at a time point "ts+Δt", and the address waveforms are applied to the address electrodes (Xd{(3n/4)+1} to Xd(n)) comprised in the electrode group (Xd) at a time point "ts+2Δt". In other words, as shown in FIG. 30A, the address waveforms are applied to the electrode groups (Xa, Xb, Xc, and Xd) comprising the address electrodes (X1 to Xn) before or after the applying time point of the scan waveform applied to the scan electrode (Y).

In FIG. 10A, the address electrodes comprised in each of the address electrode groups (Xa, Xb, Xc, and Xd) are the same in number, but it is possible to differently set the number of the address electrodes comprised in each of the address electrode groups (Xa, Xb, Xc, and Xd). Further, it is possible to control the number of the address electrode groups. The number of the address electrode groups can be set to be in a range of at least two ones to a total maximal number of the address electrodes, that is, in a range of $2 \leqq N \leqq (n-1)$.

As shown in FIG. 10B, in the other driving waveforms of the address period according to the first embodiment of the present invention, the applying time point of the address waveforms applied to the plurality of address electrode groups (Xa, Xb, Xc, and Xd) comprising the address electrodes (X1 to Xn) is later than the applying time point of the scan waveform applied to the scan electrode (Y). For example, as shown in FIG. 10B, assuming that the applying time point of the scan waveform applied to the scan electrode (Y) is "ts", the address waveforms are applied to the address electrodes comprised in the electrode group (Xa) at a time point later by Δt than a time point at which the scan waveform is applied to the scan electrode (Y), that is, at a time point "ts+Δt" adaptively to an arrangement sequence of the address electrode group comprising the address electrodes (X1 to Xn). The address waveforms are applied to the address electrodes comprised in the electrode group (Xb) at a time point later by 2Δt than a time point at which the scan waveform is applied to the scan electrode (Y), that is, at a time point "ts+2Δt". By this method, the address waveform is applied to the address electrodes comprised in the electrode group (Xc) at a time point "ts+3Δt", and the address waveform is applied to the electrode group (Xd) at a time point "ts+4Δt".

As shown in FIG. 10C, in the other driving waveforms of the address period according to the first embodiment of the present invention, the applying time points of the address waveforms applied to the address electrode groups comprising the address electrodes (X1 to Xn) are earlier than the applying time point of the scan waveform applied to the scan electrode (Y). For example, as shown in FIG. 10C, assuming that the applying time point of the scan waveform applied to the scan electrode (Y) is "ts", the address waveforms are applied to the address electrode comprised in the electrode group (Xa) at a time point earlier by Δt than a time point at which the scan waveform is applied to the scan electrode (Y), that is, at a time point "ts−Δt" adaptively to an arrangement sequence of the address electrode groups comprising the address electrodes (X1 to Xn). The address waveforms are applied to the address electrode comprised in the electrode group (Xb) at a time point earlier by 2Δt than a time point at which the scan waveform is applied to the scan electrode (Y), that is, at a time point "ts−2Δt". By this method, the address waveform is applied to the address electrode comprised in the electrode group (Xc) at a time point "ts−3Δt", and the address waveform is applied to the address electrode comprised in the electrode group (Xd) at a time point "ts−4Δt".

Even in the other driving waveform of the address period according to the first embodiment of the present invention, as described above, the difference of the applying time points between the address electrode groups can be the same as or different from each other. It is desirable that the difference of the applying time points between the address electrode groups is 10 ns to 500 ns.

Further, on one frame basis, the applying time point of the scan waveform applied to the scan electrode (Y) and the applying time points of the address waveforms applied to the address electrodes (X1 to Xn) or the address electrode groups (Xa, Xb, Xc, and Xd) are different from each other while, at each subfield, the difference between the applying time points of the address waveforms applied to the address electrodes can be set to be different from each other. This driving waveform will be described with reference to FIG. 11 below.

Figure 11:
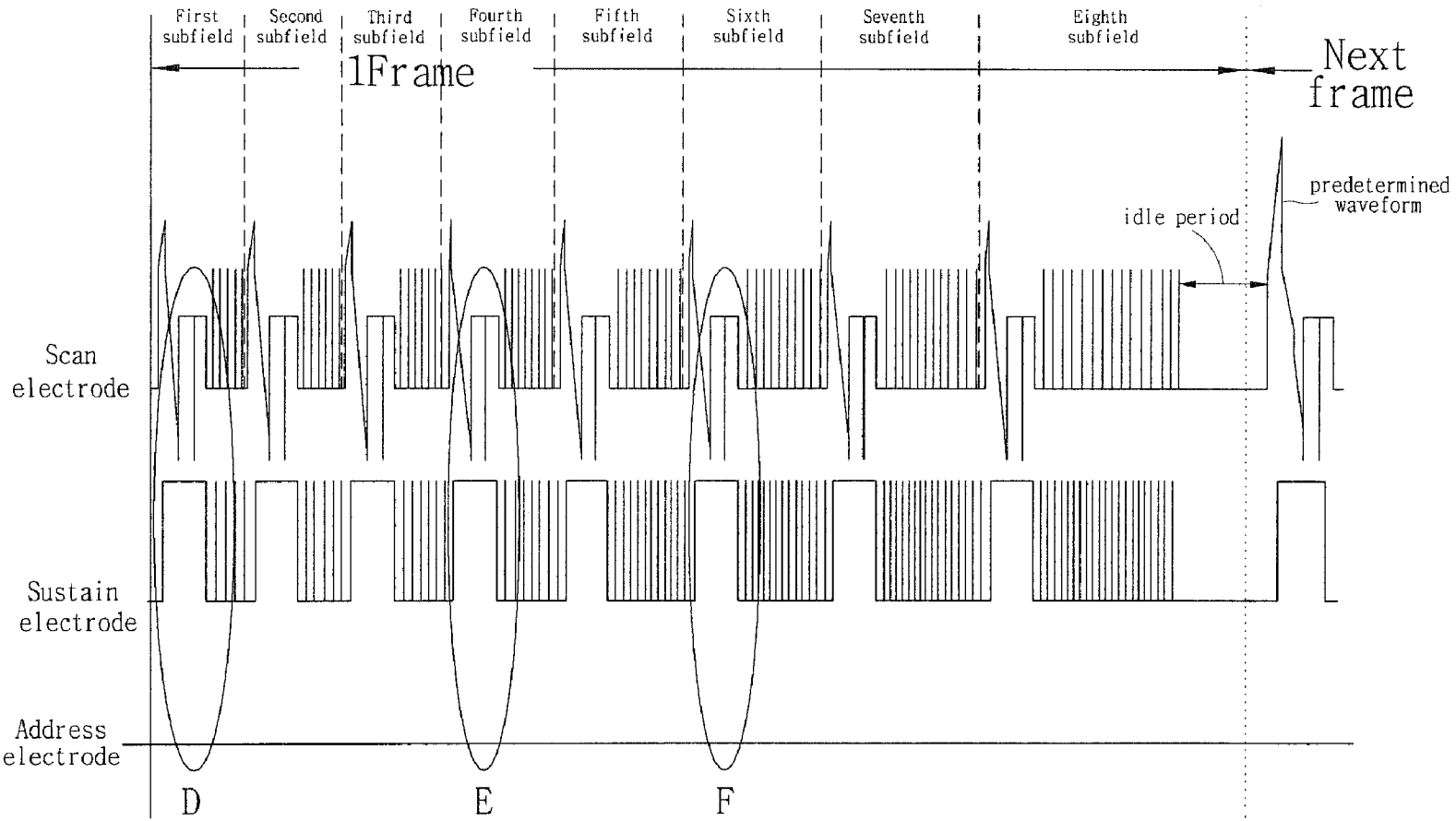
FIG. 11 illustrates another driving waveform of an address period according to the first embodiment of the present invention.

FIG. 11 illustrates another driving waveform of the address period according to the first embodiment of the present invention.

As shown in FIG. 11, in an exemplary method where the applying time points of the address waveform and the scan waveform are different from each other, in a first subfield of one frame, the applying time point of the address waveform applied to the address electrodes (X1 to Xn) is different from the applying time point of the scan waveform applied to the scan electrode (Y) while the difference between the applying time point of the address waveforms applied to the address electrode is set to "Δt". Further, like the first subfield, in a second subfield, the applying time point of the address waveform applied to the address electrodes (X1 to Xn) is different from the applying time point of the scan waveform applied to the scan electrode (Y) while the difference between the applying time points of the address waveforms applied to the address electrodes is set to "2Δt". In the above method, the differences between the applying time points of the address waveforms applied to the address electrodes can be set to be different from one another at each subfield comprised in one frame such as "3Δt" and "4Δt".

Alternatively, in the driving waveform of the present invention, in at least one subfield, the applying time point of the address waveform and the applying time point of the scan waveform are different from each other while, at each subfield, the applying time point of the address waveform can be also set, differently from one another, to be earlier and later than applying time point of the scan waveform. For example, in the first subfield, the applying time point of the address waveform is set to be earlier and later than the applying time point of the scan waveform, and in the second subfield, the applying time points of the address waveforms are all set to be earlier than the applying time point of the scan waveform, and in the third subfield, all of the applying time points of the address waveforms can be also set to be later than the applying time point of the scan waveform. Regions 'D', 'E', and 'F' of FIG. 11 will be in more detail described with reference to FIGS. 12A to 12C below.

Figure 12A:
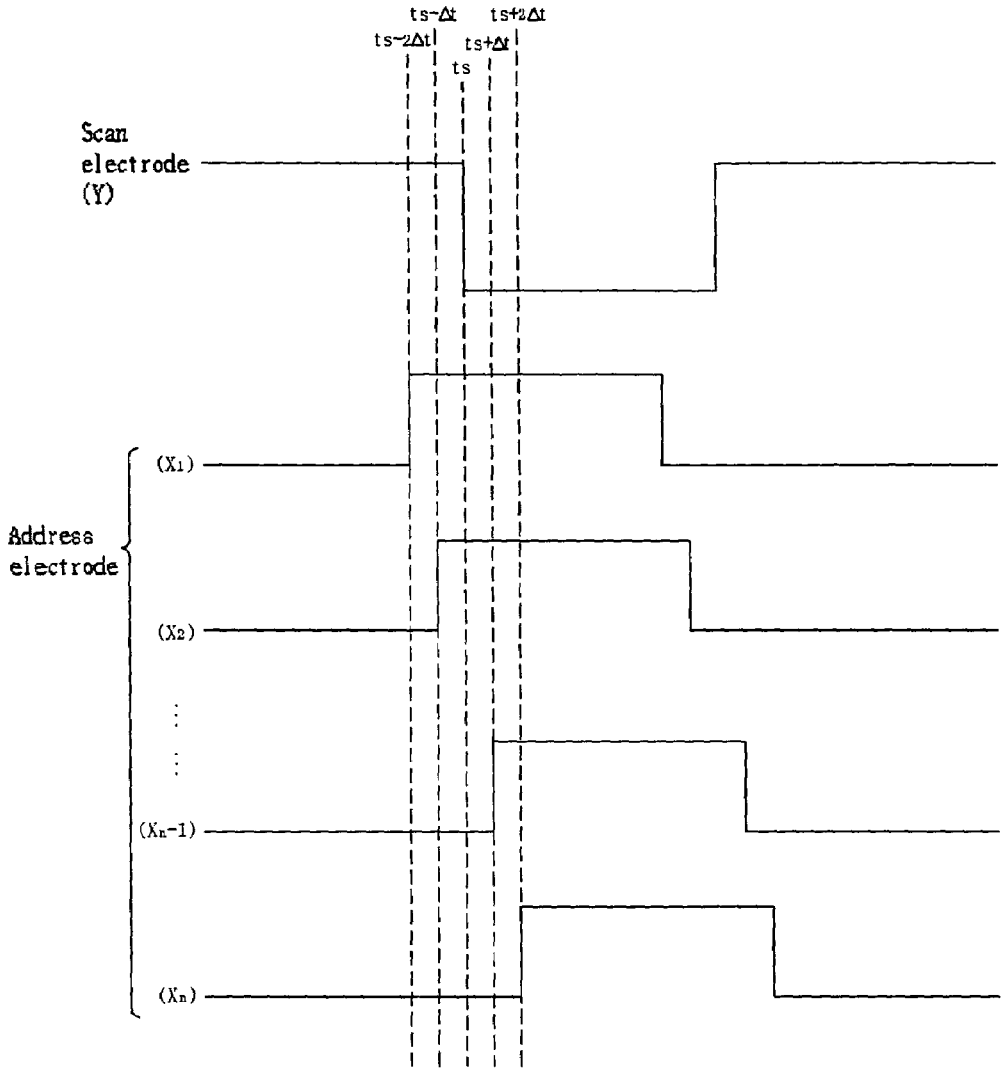
FIGS. 12A to 12C illustrates a driving waveform of FIG. 11 in more detail.
Figure 12B:
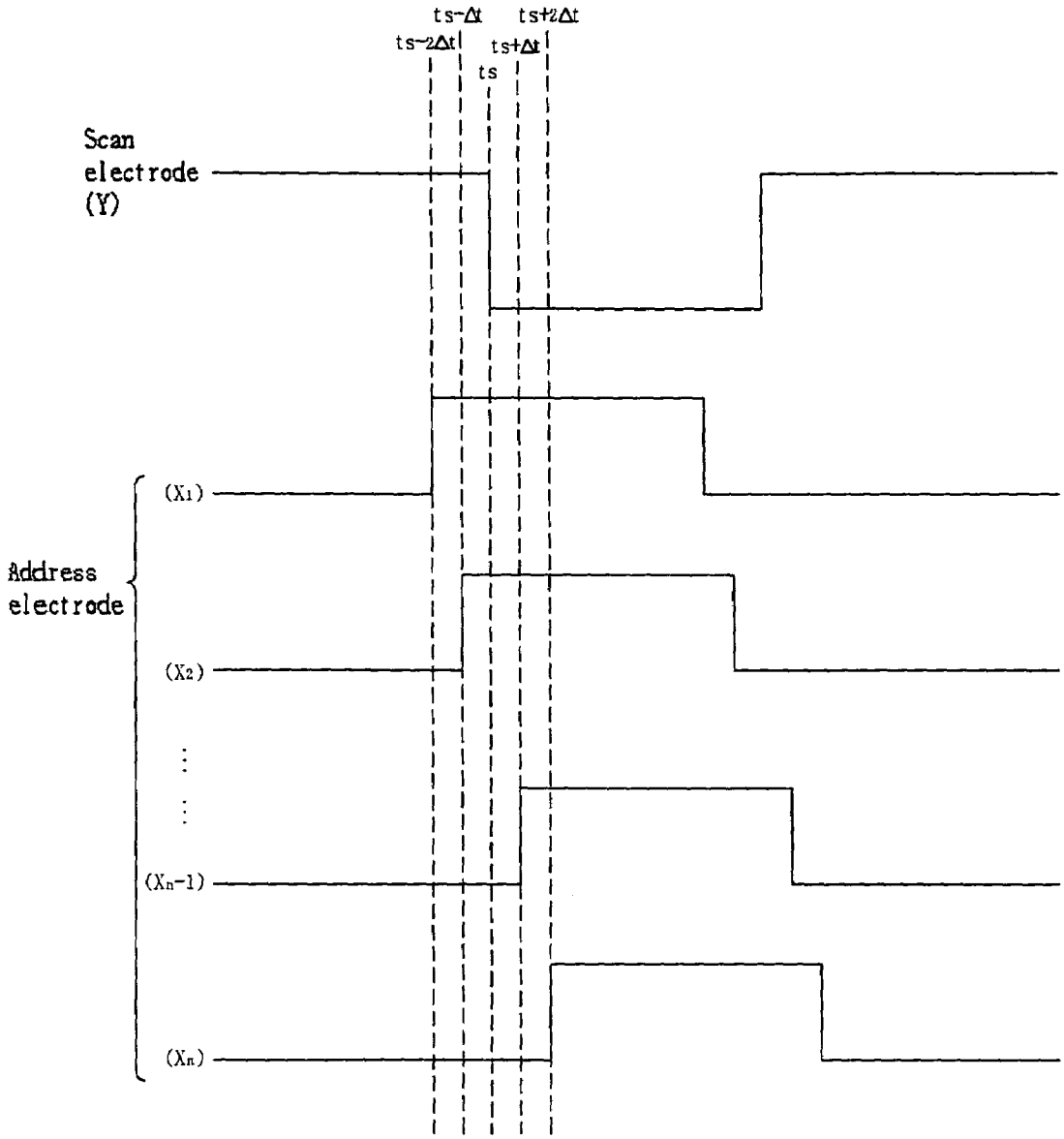
Figure 12C:
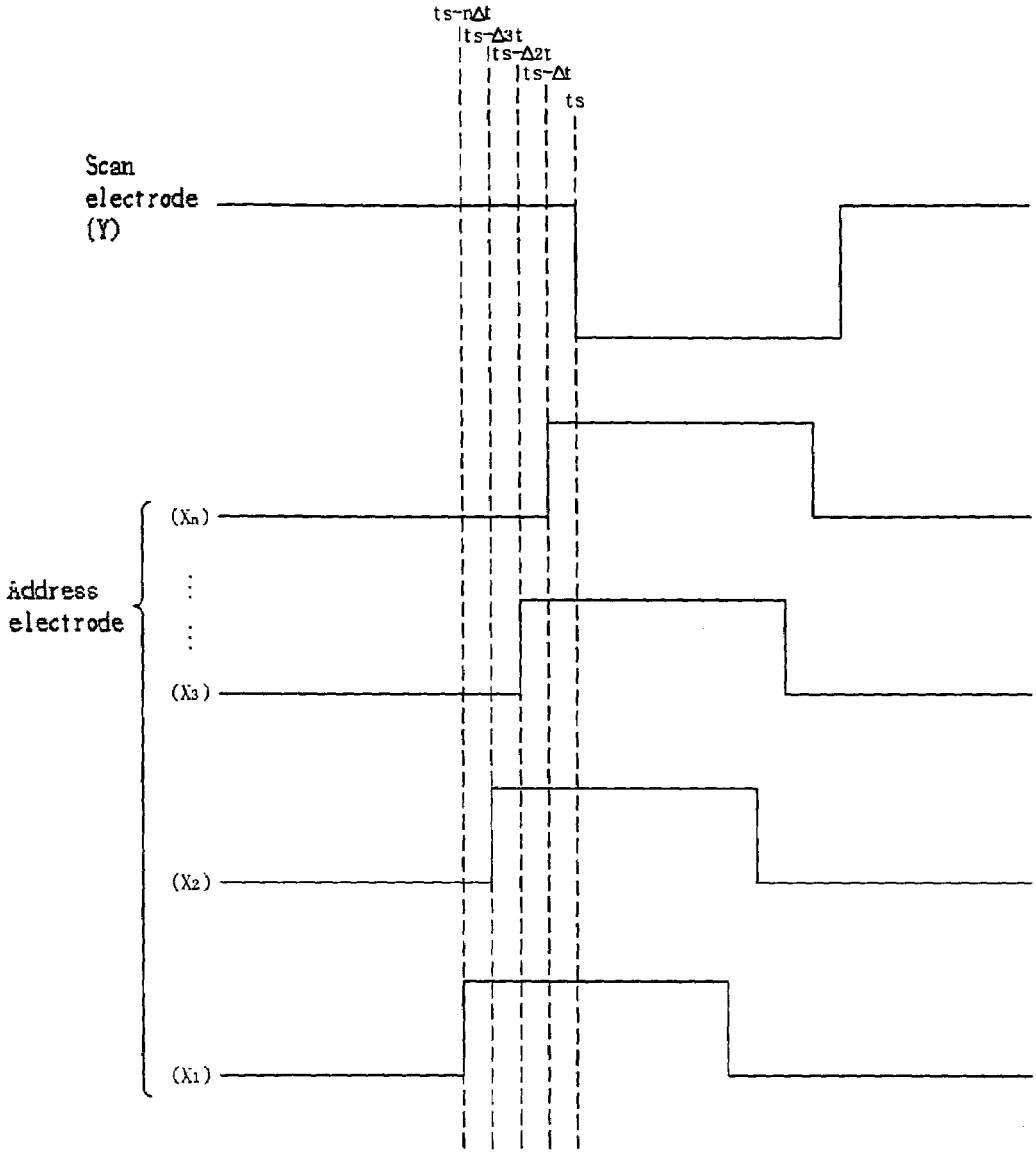

FIGS. 12A to 12C illustrate the driving waveform of FIG. 11 in more detail.

Referring first to FIG. 12A, in the first subfield, assuming that the applying time point of the scan waveform applied to the scan electrode (Y) is "ts", in the D region of FIG. 11, the address waveform is applied to the address electrode (X1) at a time point earlier by 2Δt than a time point at which the scan waveform is applied to the scan electrode (Y), that is, at a time point "ts−2Δt" adaptively to an arrangement sequence of the address electrodes (X1 to Xn). The address waveform is applied to the address electrode (X2) at a time point earlier by Δt than a time point at which the scan waveform is applied to the scan electrode (Y), at a time point "ts−Δt". By this method, the address waveform is applied to the electrode (Xn−1) at a time point "ts−Δt", and the address waveform is applied to the electrode (Xn) at a time point "ts−2Δt".

Referring to FIG. 12B, in the region 'E' of FIG. 11, the applying time point of the address waveform applied to the address electrodes (X1 to Xn) is different from the applying time point of the scan waveform applied to the scan electrode (Y), and the applying time points of all address waveforms are later than the applying time point of the scan waveform described above. For example, as shown in FIG. 12B, in another driving waveform of the address period according to the first embodiment of the present invention, assuming that the applying time point of the scan waveform applied to the scan electrode (Y) is "ts", the address waveform is applied to the address electrode (X1) at a time point later by Δt than a time point at which the scan waveform is applied to the scan electrode (Y), that is, at a time point "ts+Δt" adaptively to the arrangement sequence of the address electrodes (X1 to Xn). The address waveform is applied to the address electrode (X2) at a time point later by 2Δt than a time point at which the scan waveform is applied to the scan electrode (Y), that is, at a time point "ts+2Δt". By this method, the address waveform is applied to the electrode (X3) at a time point "ts+3Δt", and the address waveform is applied to the electrode (Xn) at a time point "ts+nΔt".

Referring to FIG. 12C, in the region 'F' of FIG. 11, the applying time point of the address waveform applied to the address electrodes (X1 to Xn) is different from the applying time point of the scan waveform applied to the scan electrode (Y), and the applying time points of all address waveforms are earlier than the applying time point of the scan waveform described above. For example, as shown in FIG. 12C, in another driving waveform of the address period according to the first embodiment of the present invention, assuming that the applying time point of the scan waveform applied to the scan electrode (Y) is "ts", the address waveform is applied to the address electrode (X1) at a time point earlier by Δt than a time point at which the scan waveform is applied to the scan electrode (Y), that is, at a time point "ts−Δt" adaptively to the arrangement sequence of the address electrodes (X1 to Xn). The address waveform is applied to the address electrode (X2) at a time point earlier by 2Δt than a time point at which the scan waveform is applied to the scan electrode (Y), that is, at a time point "ts−2Δt". By this method, the address waveform is applied to the electrode (X3) at a time point "ts−3Δt", and the address waveform is applied to the electrode (Xn) at a time point "ts−nΔt".

If the applying time point of the scan waveform applied to the scan electrode (Y) and the applying time point of the address waveform applied to the address electrodes (X1 to Xn) are different in the address period at each subfield as described above, coupling through a capacitance of the panel is reduced at each applying time point of the address waveform applied to the address electrodes (X1 to Xn), thereby reducing the noises of the waveforms applied to the scan electrode and the sustain electrode. Accordingly, the address discharge generated in the address period can be stabilized, thereby suppressing reduction of the driving stability of the plasma display apparatus.

As described above, it will understand by those skilled in the art of the present invention that the present invention can be embodied in other concrete forms without modification of a technological spirit or an essential feature.

For example, the above illustrates and describes only a method where the address waveform is applied to all address electrodes (X1 to Xn) at the time point different from the time point at which the scan waveform is applied to all the address electrodes (X1 to Xn), or all the address electrodes are grouped as four electrode groups having the same number of the address electrodes according to the arrangement sequence, and the address waveform is applied at each electrode group at the time point different from the time point at which the scan waveform is applied. However, unlike this, there can be also provided a method where among all the address electrodes (X1 to Xn), the odd numbered address electrodes are set as one electrode group, and the even numbered address electrodes are set as another electrode group, and the address waveform is applied at the same time point to all the address electrodes within the same electrode group, and the applying time point of the address waveform of each electrode group is set to be different from the applying time point at which the scan waveform is applied.

Further, there can be provided a method where the address electrodes (X1 to Xn) are grouped as the plurality of electrode groups having the number of the address electrodes having at least one different address electrode, and the address waveform is applied at each electrode group at the time point different from the applying time point of the scan waveform. For example, the driving waveform of the plasma display apparatus of the present invention can be variously modified in such a manner that, assuming that the applying time point of the scan waveform applied to the scan electrode (Y) is "ts", the address waveform is applied to the address electrode (X1) at the time point "ts+Δt", and the address waveforms are applied to the address electrodes (X2 to Xn) at the time point "ts+3Δt", and the address waveforms are applied to the address electrodes (X11 to Xn) at the time point "ts+4Δt".

Second Embodiment

Unlike the plasma display apparatus according to the first embodiment, even a plasma display apparatus according to the second embodiment of the present invention comprises a plasma display panel, a data driver, a scan driver, and a sustain driver.

Unlike the plasma display apparatus according to the first embodiment, in the inventive plasma display apparatus according to the second embodiment, before application of a reset waveform, the scan driver applies a negative waveform to a scan electrode, and the sustain driver applies a positive waveform corresponding to the negative waveform to a sustain electrode. In the second embodiment of the present invention, such the waveform is called "pre reset waveform", and a period therefore is called "pre reset period". In the same manner as the first embodiment of the present invention, an idle period from an applying time point of a last sustain waveform applied to the scan electrode or the sustain electrode to a time point of applying a predetermined waveform is different depending on a temperature of the plasma display panel.

Each function part according to the second embodiment of the present invention has an operation characteristic substantially similar with the function part of the first embodiment of the present invention described in FIG. 5 and therefore, its duplicate description will be omitted.

Figure 13:
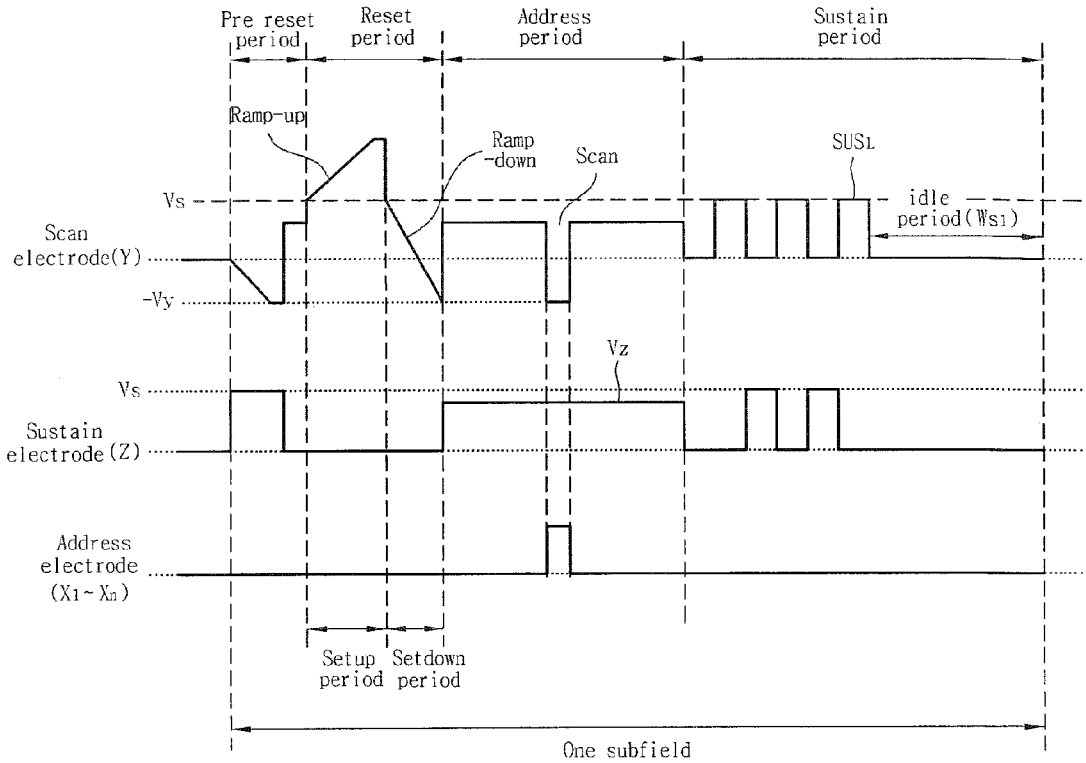
FIG. 13 illustrates a driving waveform according to the second embodiment of the present invention.

FIG. 13 illustrates a driving waveform according to the second embodiment of the present invention.

As shown in FIG. 13, the inventive plasma display apparatus is driven with each subfield divided into a pre reset period and a reset period for initializing all cell consequently to the pre reset period, an address period for selecting a cell to be discharged, a sustain period for sustaining a discharge of the selected cell, and an idle period.

The description of the reset period, the address period, the sustain period, and the idle period according to the second embodiment of the present invention are enough made through FIG. 6 and therefore, their description will be omitted. In particular, the idle period of the second embodiment has the same feature as that of the first embodiment and accordingly, even in the second embodiment of the present invention, a high temperature erroneous discharge can be suppressed. In the second embodiment of the present invention, the pre reset period is further provided, thereby more stably driving the plasma display apparatus.

In such the pre reset period, positive charges are accumulated on the scan electrode within a discharge cell, and negative charges are accumulated on the sustain electrode. In the pre reset period, in order to accumulate the charges, a ramp waveform in which a voltage is gradually varied in magnitude is applied to any one of the scan electrode and the sustain electrode. In other words, the ramp waveform can be applied only to the scan electrode or the sustain electrode, or the ramp waveform can be applied to both the scan electrode and the sustain electrode.

In order to accumulate the positive charges on the scan electrode and accumulate the negative charges on the sustain electrode, it is desirable that the negative waveform is applied to the scan electrode, and the positive waveform is applied to the sustain electrode. Together with this, as aforementioned, a ramp-down waveform having a negative voltage where a voltage gradually falls is applied to the scan electrode, or a ramp-up waveform having a positive voltage where a voltage gradually rises is applied to the sustain electrode.

More preferably, since the negative waveform applied to the scan electrode can be supplied using the same voltage source as that of a setdown waveform of the reset waveform, the negative waveform applied to the scan electrode is applied as the ramp-down waveform considering easiness of control. It is desirable that the positive voltage applied to the sustain electrode is a positive voltage constantly sustaining a predetermined voltage level.

The negative voltage of the ramp-down waveform applied to the scan electrode is set to fall from a ground level (GND) to a predetermined voltage. Preferably, the negative voltage of the ramp-down waveform falls up to a lower limit value of a voltage of the setdown waveform applied to the scan electrode in the reset period or the scan waveform applied to the scan electrode in the address period. In other words, by controlling only a control timing of the voltage source for applying the setdown waveform or the scan waveform without adding other voltage sources, the driving waveform according to the second embodiment of the present invention can be implemented. A falling slope of the ramp-down waveform applied to the scan electrode is controllable. For example, when it is intended to lead space charges more fast and strongly, the slope can be abrupt, that is, a rising time can be short.

Preferably, a voltage of the positive waveform applied to the sustain electrode is a sustain voltage (Vs) supplied from the same voltage source as that of the sustain waveform.

As such, there is provided the pre reset period for accumulating wall charges between the sustain period and the reset period and, in the pre reset period, the negative voltage is applied to the scan electrode and the positive voltage is applied to the sustain electrode to accumulate positive wall charges on the scan electrode within the discharge cell and accumulate negative wall charges on the sustain electrode, thereby reducing a maximal voltage level of the setup waveform in a consequent reset period. This is because, before the setup waveform serving to accumulate the wall charges within the discharge cell is applied, in the pre reset period, a predetermined amount of wall charges is already accumulated and therefore, a sufficient amount of wall charges necessary for setup within the discharge cell can be accumulated even though the maximal voltage level of the setup waveform is low. As the maximal voltage level is lowered, a power consumption of a driving device can be reduced, and a driving period as much reduced can be secured.

Meantime, the pre reset period according to the second embodiment of the present invention can be provided before the reset period of at least any one of a plurality of subfields.

In case where the pre reset period is provided between two subfields, it is preferably provided between a sustain period of a previous subfield and a reset period of a next subfield.

However, a length of one frame is limited and, considering a driving margin of the reset period, the address period, or the sustain period, a pre discharge is preferably comprised in one subfield of the frame. More preferably, considering that the space charges within the discharge cell can be led on a predetermined electrode within the discharge cell in an initiation step of one frame, thereby enhancing a driving efficiency, the pre reset period is provided before a reset period of a first subfield of one frame.

As such, in the pre reset period, the negative voltage is applied to the scan electrode, and the positive voltage is applied to the sustain electrode, thereby reducing an amount of the space charges within the discharge cell. The reduction of the space charges within the discharge cell will be described with reference to FIG. 10.

Figure 14:
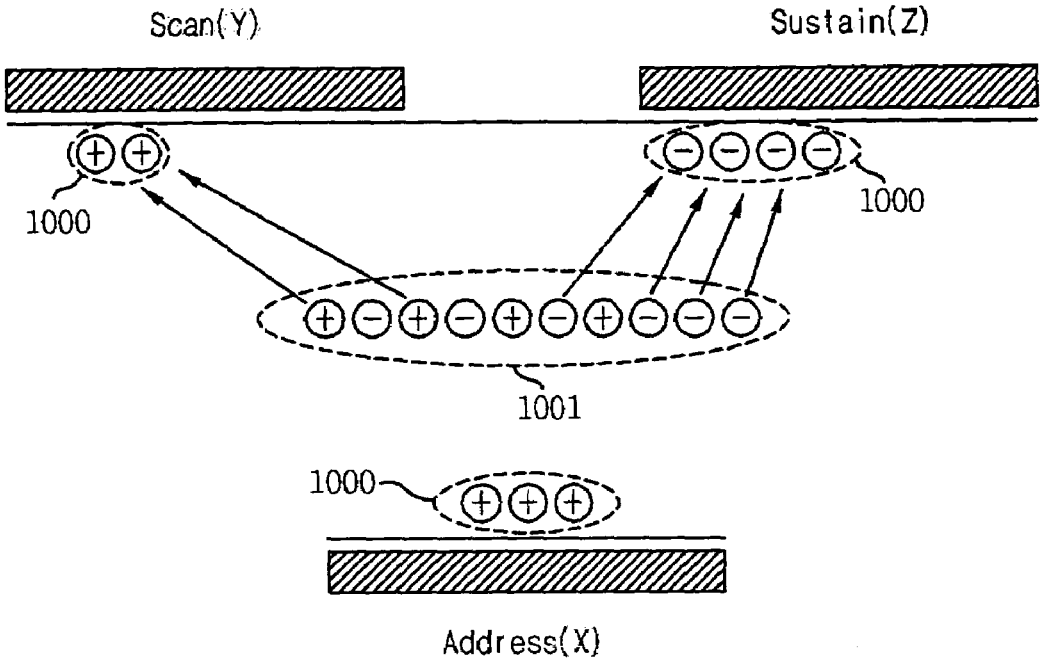
FIG. 14 illustrates a charge state within a discharge cell according to the second embodiment of the present invention.

FIG. 14 illustrates a charge state within the discharge cell according to the second embodiment of the present invention.

As shown in FIG. 14, if in the pre reset period, the negative voltage is applied to the scan electrode (Y), and the positive voltage is applied to the sustain electrode (Z), the space charges 1001 not participating in discharge within the discharge cell are led on the scan electrode (Y) or the sustain electrode (Z), and the led space charges 1100 are operated as the wall charges 1000 on the scan electrode (Y) or the sustain electrode (Z). Accordingly, an absolute amount of the space charges 1001 is reduced, and an amount the wall charges 1000 positioned on each electrode within the discharge cell is increased. Accordingly, even though the plasma display panel is relatively increased in temperature, an amount of the wall charges 1000 within the discharge cell is sufficiently provided. In other words, the absolute amount of the wall charges can be reduced, thereby more effectively reducing the generated high temperature erroneous discharge.

Third Embodiment

Unlike the plasma display apparatuses according to the first and second embodiments, even a plasma display apparatus according to the third embodiment of the present invention comprised a plasma display panel, a data driver, a scan driver, and a sustain driver.

Unlike the plasma display apparatuses according to the first and second embodiments, in the inventive plasma display apparatus according to the third embodiment, there are provided a pre reset waveform, an address waveforms having a different applying time point, and an idle waveform depending on temperature during a period of one frame, more preferably, during a period of one subfield. Each function part according to the third embodiment of the present invention has an operation characteristic substantially similar with that of the first embodiment described in FIG. 5 and therefore, their duplicate description will be omitted.

Figure 15:
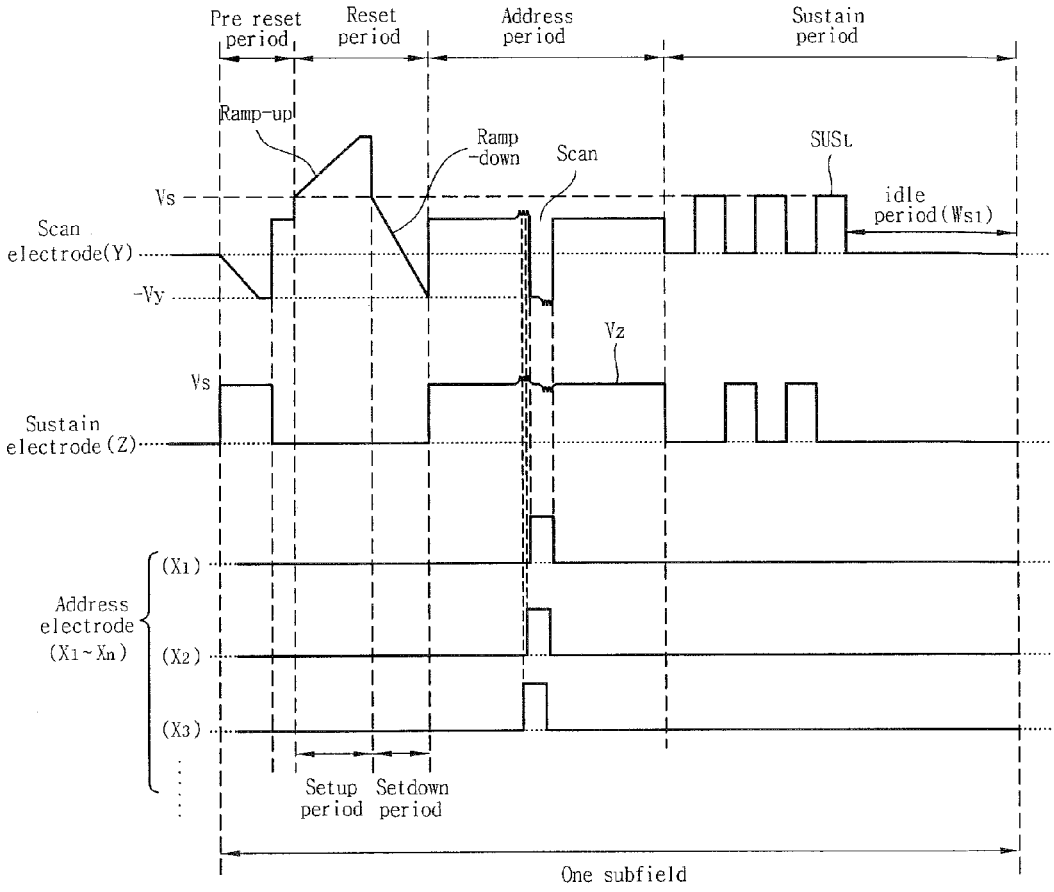
FIG. 15 illustrates a driving waveform according to the third embodiment of the present invention.

FIG. 15 illustrates a driving waveform according to the third embodiment of the present invention.

As shown in FIG. 15, the plasma display apparatus according to the third embodiment of the present invention is driven with each subfield divided into a pre reset period and a reset period for initializing all cell consequently to the pre reset period, an address period for selecting a cell to be discharged, a sustain period for sustaining a discharge of the selected cell, and an idle period.

The driving waveform according to the third embodiment of the present invention comprised the pre reset waveform, the address waveforms having the different applying time point, and the idle waveform depending on temperature, that are described in the first and second embodiments of the present invention. Accordingly, a high temperature erroneous discharge can be more effectively suppressed, and noise generated in the address period can be reduced, thereby stabilizing the address discharge and, together with this, a driving margin can be improved.

In other words, an effect improved more than the effects described in the first and second embodiments of the present invention can be expected. For example, as the driving period is sufficiently secured through the pre reset period, the difference of the applying time point between the address waveforms can be more minute, and a controllable range of the idle period can be more expanded.

A description of the reset period, the address period, the sustain period, and the idle period, and a description of the pre reset period are enough made through FIG. 6 and FIG. 13, respectively, and therefore, will be omitted.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus comprising:

a plasma display panel comprising a plurality of scan electrodes, sustain electrodes, and address electrodes intersecting with the scan electrodes;

a scan driver for applying waveforms to at least one scan electrode, the waveforms including a reset waveform and a scan waveform applied subsequent to the reset waveform;

a sustain driver for applying waveforms to at least one sustain electrode, the waveforms including a waveform corresponding to the scan waveform; and a data driver for applying address waveforms to the address electrodes, wherein the data driver applies the address waveforms at different time points to the address electrodes relative to a time point at which the scan waveform is applied to the scan electrode, and wherein the scan driver changes a duration of an idle period when a temperature of the plasma display panel exceeds a threshold temperature, the idle period occurring between a time point when a last sustain waveform is applied to the scan electrode or the sustain electrode and a time point when a predetermined waveform is applied during a subsequent subfield.

2. The apparatus of claim 1, wherein the predetermined waveform is any one of a setup waveform, a setdown waveform or a scan waveform.

3. The apparatus of claim 1, wherein, when the temperature of the plasma display panel exceeds a first threshold temperature, the scan driver makes the idle period longer than when the temperature is less than the first threshold temperature.

4. The apparatus of claim 3, wherein the first threshold temperature is at least substantially 40° C.

5. The apparatus of claim 1, wherein the idle period is 100 μs to 1 ms.

6. The apparatus of claim 1, wherein the last sustain waveform has a pulse width of 1 μs to 1 ms.

7. The apparatus of claim 1, wherein the address waveforms are applied relative to a same scan waveform and are applied to the mutually different address electrodes have mutually different applying time points.

8. The apparatus of claim 1, wherein the threshold temperature is greater than a room temperature.

9. The apparatus of claim 1, wherein the subsequent subfield is in a frame that comes after a frame in which the last sustain waveform is applied.

10. The apparatus of claim 1, wherein the subsequent subfield and a subfield in which the last sustain waveform are applied in a same frame.

11. The apparatus of claim 1, wherein the scan driver changes the duration of the idle period when a temperature of the plasma display panel rises above the threshold temperature.

12. A plasma display apparatus comprising:

a plasma display panel comprising a plurality of scan electrodes, sustain electrodes, and address electrodes intersecting with the scan electrodes;

a scan driver for applying waveforms to a scan electrode, the waveforms including a reset waveform and a scan waveform applied subsequent to the reset waveform; and a sustain driver for applying waveforms to a sustain electrode, the waveforms including a waveform corresponding to the scan waveform, wherein the scan driver changes a duration of an idle period when a temperature of the plasma display panel exceeds a threshold temperature, the idle period corresponding to a period of time between a time point when a last sustain waveform is applied to the scan electrode or the sustain electrode and a time point when a predetermined waveform is applied during a subsequent subfield.

13. The apparatus of claim 12, wherein, when the temperature of the plasma display panel exceeds a first threshold temperature, the scan driver makes the idle period longer than when the temperature is less than the first threshold temperature.

14. The apparatus of claim 13, wherein the first threshold temperature is at least substantially 40° C.

15. The apparatus of claim 12, wherein the idle period is 100 μs to 1 ms.

16. The apparatus of claim 12, wherein the last sustain waveform has a pulse width of 1 μs to 1 ms.

17. The apparatus of claim 12, wherein the threshold temperature is greater than a room temperature.

18. A driving method of a plasma display apparatus having a plasma display panel comprising a plurality of scan electrodes, sustain electrodes, and address electrodes intersecting with the scan electrodes, the method comprising:

applying a first waveform to a scan electrode and applying a second waveform corresponding to the first waveform to a sustain electrode during a first period; and applying a scan waveform to the scan electrode and address waveforms to address electrodes during a second period, wherein the address waveforms are applied at different time points to the address electrode relative to a time point at which the scan waveform is applied to the scan electrode, wherein a duration of an idle period is changed when a temperature of the plasma display panel exceeds a threshold temperature, the idle period occurring between a time point when a last sustain waveform is applied to the scan electrode or the sustain electrode and a time point when a predetermined waveform is applied during a subsequent subfield.

19. The method of claim 18, wherein the idle period is 100 μs to 1 ms.

20. The method of claim 18, wherein the last sustain waveform has a pulse width of 1 μs to 1 ms.

* * * * *